US006012725A

United States Patent [19]

Mitchell et al.

[11] Patent Number: 6,012,725

[45] Date of Patent: Jan. 11, 2000

[54] SKATE BRAKE SYSTEMS AND METHODS

[75] Inventors: David N. Mitchell, Englewood; Gregory C. Sturgeon, Brighton, both of Colo.

[73] Assignee: Out of Line Sports, Inc., Littleton, Colo.

[21] Appl. No.: 09/187,942

[22] Filed: Nov. 6, 1998

Related U.S. Application Data

[63] Continuation-in-part of application No. 08/924,442, Aug. 26, 1997, Pat. No. 5,829,756, which is a continuation-in-part of application No. 08/801,858, Feb. 18, 1997, Pat. No. 5,836,590.

[51] Int. Cl.[7] ..... A63C 17/14

[52] U.S. Cl. ..... 280/11.2

[58] Field of Search ..... 280/11.2; 188/20, 188/29

[56] References Cited

U.S. PATENT DOCUMENTS

| | | | |
|---|---|---|---|
| 26,414 | 11/1896 | Napier . | |
| 920,848 | 5/1909 | Eubank, Jr. . | |
| 922,774 | 5/1909 | Kennedy . | |
| 979,169 | 12/1910 | Kennedy . | |
| 1,371,623 | 3/1921 | Ickenroth . | |
| 1,402,010 | 1/1922 | Ormiston . | |
| 1,456,881 | 5/1923 | Carley . | |
| 1,497,224 | 6/1924 | Ormiston . | |
| 1,524,286 | 1/1925 | Bried . | |
| 1,687,739 | 10/1928 | Slusher . | |
| 1,801,205 | 4/1931 | Mirick . | |
| 2,027,487 | 1/1936 | Means . | |
| 2,179,592 | 11/1939 | Goettie . | |
| 2,208,888 | 7/1940 | Whited . | |
| 3,062,328 | 11/1962 | Butler et al. | 188/33 |

(List continued on next page.)

FOREIGN PATENT DOCUMENTS

| | | |
|---|---|---|
| 2055565 | 5/1992 | Canada . |
| 0 243 560 | 12/1986 | European Pat. Off. . |
| 0 379 906 | 1/1990 | European Pat. Off. . |
| 0 471 645 A3 | 7/1991 | European Pat. Off. . |
| 0 545 250 A2 | 11/1992 | European Pat. Off. . |
| 0 567 948 A1 | 4/1993 | European Pat. Off. . |
| 0 568 878 A1 | 4/1993 | European Pat. Off. . |
| 0 585 764 A1 | 8/1993 | European Pat. Off. . |
| 0 594 080 A2 | 10/1993 | European Pat. Off. . |
| 0 599 043 A2 | 10/1993 | European Pat. Off. . |
| 0 600 274 A1 | 11/1993 | European Pat. Off. . |
| 0 608 740 A2 | 1/1994 | European Pat. Off. . |
| 0 610 652 A1 | 1/1994 | European Pat. Off. . |
| 0 613 705 A1 | 2/1994 | European Pat. Off. . |
| 0 656 220 A2 | 10/1994 | European Pat. Off. . |
| 0 656 221 A1 | 11/1994 | European Pat. Off. . |
| 2 627 995 | 3/1988 | France . |
| 2 670 125 | 12/1990 | France . |
| 223485 | 11/1908 | Germany . |
| 230621 | 6/1910 | Germany . |
| 386288 | 12/1922 | Germany . |
| 438462 | 1/1925 | Germany . |
| 2305830 | 1/1938 | Germany . |
| 952 693 | 11/1956 | Germany . |
| 25 37 778 | 3/1977 | Germany . |
| 29 25 555 | 1/1981 | Germany . |
| 57-160483 | 2/1982 | Japan . |
| 89/03712 | 5/1989 | WIPO . |
| 93/14841 | 8/1993 | WIPO . |
| WO 98/35732 | 8/1998 | WIPO . |

*Primary Examiner*—Lanna Mai
*Assistant Examiner*—Faye M. Fleming
*Attorney, Agent, or Firm*—Townsend and Townsend and Crew LLP

[57] ABSTRACT

The invention provides braking systems and methods for slowing or stopping a roller skate having a plurality of wheels. In one exemplary system, at least one braking surface is spaced-apart from the wheels. A rotatable wheel engaging member is positioned between the braking surface and at least one of the wheels. The rotatable wheel engaging member is caused to rotate when moved against at least one of the wheels when rotating. Further, the rotatable member has an engaging surface which moves against the braking surface upon rotation of the rotatable member by the wheel to slow or stop the wheel.

28 Claims, 41 Drawing Sheets

U.S. PATENT DOCUMENTS 3,224,785 12/1965 Stevenson .
3,339,936 9/1967 Hamlin .
3,528,672 9/1970 Wunder .
3,583,052 6/1971 Herbenar et al. ..... 29/175
3,734,244 5/1973 Roddy .
3,767,220 10/1973 Peterson .
3,876,217 4/1975 Copier .
3,884,486 5/1975 Wilje .
3,904,215 9/1975 Bardy .
3,933,220 1/1976 Swager ..... 182/3
4,003,582 1/1977 Maurer .
4,033,433 7/1977 Kirk ..... 188/25
4,033,596 7/1977 Andorsen et al. .
4,048,938 9/1977 Patterson, III et al. ..... 114/75
4,076,266 2/1978 Krausz .
4,092,033 5/1978 Swain .
4,108,451 8/1978 Scheck .
4,172,676 10/1979 De Chant ..... 403/43
4,181,227 1/1980 Balstad .
4,181,316 1/1980 Brand et al. .
4,183,546 1/1980 Heilig .
4,194,751 3/1980 Shinmura .
4,275,895 6/1981 Edwards .
4,300,781 11/1981 Riggs .
4,312,514 1/1982 Horowitz et al. .
4,363,493 12/1982 Veneklasen .
4,402,520 9/1983 Ziegler .
4,453,726 6/1984 Ziegler .
4,526,389 7/1985 Chase .
4,805,936 2/1989 Krantz .
4,817,974 4/1989 Bergeron .
4,852,697 8/1989 Kulik ..... 188/2
4,943,072 7/1990 Henig .
5,088,748 2/1992 Koselka et al. .
5,118,122 6/1992 Ricart .
5,125,687 6/1992 Hwang .
5,171,032 12/1992 Dettmer .
5,183,275 2/1993 Hoskin .
5,183,292 2/1993 Ragin, III .
5,192,099 3/1993 Riutta .
5,193,827 3/1993 Olson ..... 280/7.13
5,211,409 5/1993 Mitchell et al. .
5,226,673 7/1993 Cech .
5,251,934 10/1993 Gates .
5,253,882 10/1993 Mitchell .
5,280,930 1/1994 Smathers et al. .
5,280,931 1/1994 Horton .
5,286,043 2/1994 Tkacyk .
5,308,093 5/1994 Walin .
5,316,325 5/1994 Mitchell et al. .
5,320,367 6/1994 Landis .
5,330,207 7/1994 Mitchell .
5,330,208 7/1994 Charron et al. .
5,340,131 8/1994 Smathers et al. .
5,342,071 8/1994 Soo .
5,351,974 10/1994 Cech .
5,374,070 12/1994 Pellegrini, Jr. et al. ..... 280/11.2
5,374,071 12/1994 Johnson .
5,375,859 12/1994 Peck et al. .
5,388,844 2/1995 Pellegrini, Jr. et al. .
5,397,137 3/1995 Pellegrini, Jr. et al. ..... 280/11.2
5,397,138 3/1995 Mangelsdorf .
5,398,948 3/1995 Mathis ..... 280/11.19
5,401,038 3/1995 Peck et al. .
5,403,021 4/1995 Shifrin .
5,411,276 5/1995 Moldenhauer .
5,415,419 5/1995 Bourque .
5,435,579 7/1995 Pozzobon ..... 280/11.2
5,439,238 8/1995 Neal .
5,462,296 10/1995 Pozzobom ..... 280/11.2
5,462,297 10/1995 Lee .
5,478,094 12/1995 Pennestri .
5,501,474 3/1996 Conte .
5,511,803 4/1996 Klukos .
5,511,804 4/1996 Pellegrini, Jr. et al. ..... 280/11.2
5,511,805 4/1996 McGrath ..... 280/11.2
5,551,712 9/1996 Repucci .
5,564,718 10/1996 Mitchell et al. .
5,570,759 11/1996 Zorzi ..... 188/5
5,582,418 12/1996 Closser .
5,630,596 5/1997 Rudolph ..... 280/11.2
5,647,599 7/1997 Visger et al. ..... 280/11.2
5,649,715 7/1997 Mitchell ..... 280/11.2
5,651,556 7/1997 Mitchell ..... 280/11.2
5,664,794 9/1997 Mitchell ..... 280/11.2
5,685,550 11/1997 Mayer, II ..... 280/11.2
5,704,618 1/1998 Sfoggia ..... 280/11.2
5,704,619 1/1998 Mitchell et al. ..... 280/11.2
5,755,449 5/1998 Pozzobon ..... 280/11.2
5,829,756 11/1998 Mitchell et al. ..... 280/11.2
5,836,590 11/1998 Mitchell et al. ..... 280/11.2

FIG - 20B
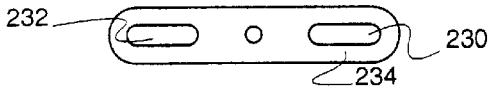
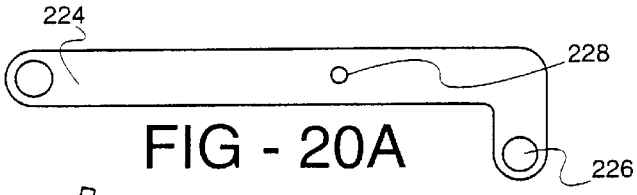
FIG - 20A
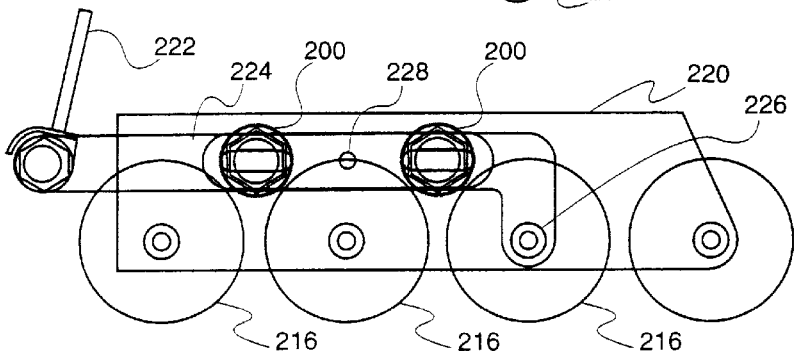
FIG - 20
FIG - 21C
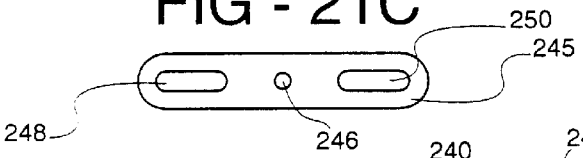
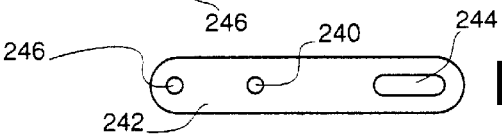
FIG - 21B
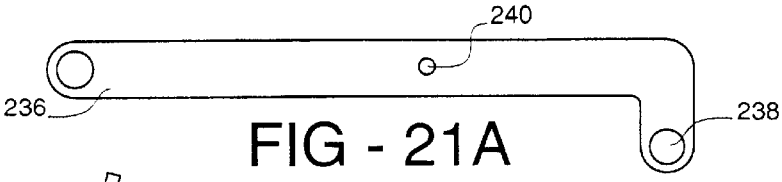
FIG - 21A
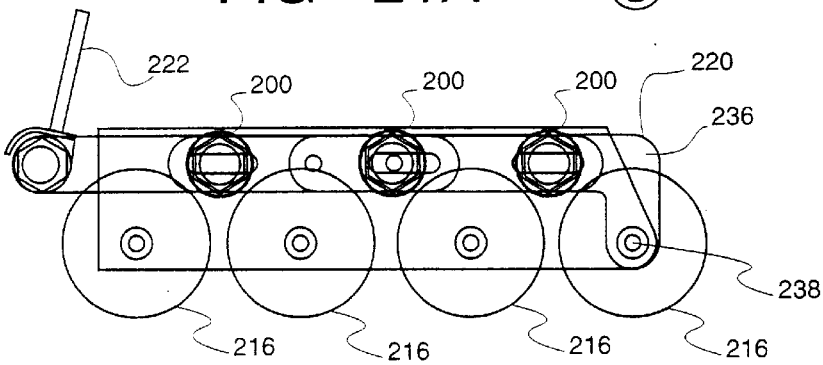
FIG - 21

FIG - 22B
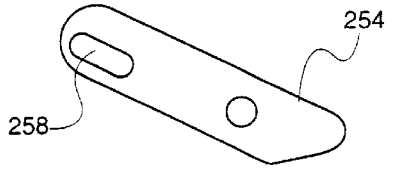
FIG - 22A
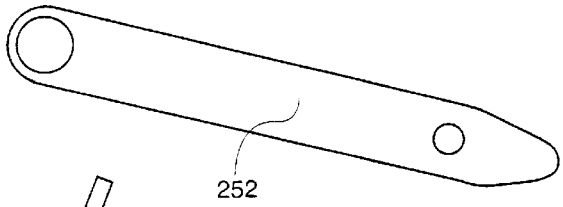
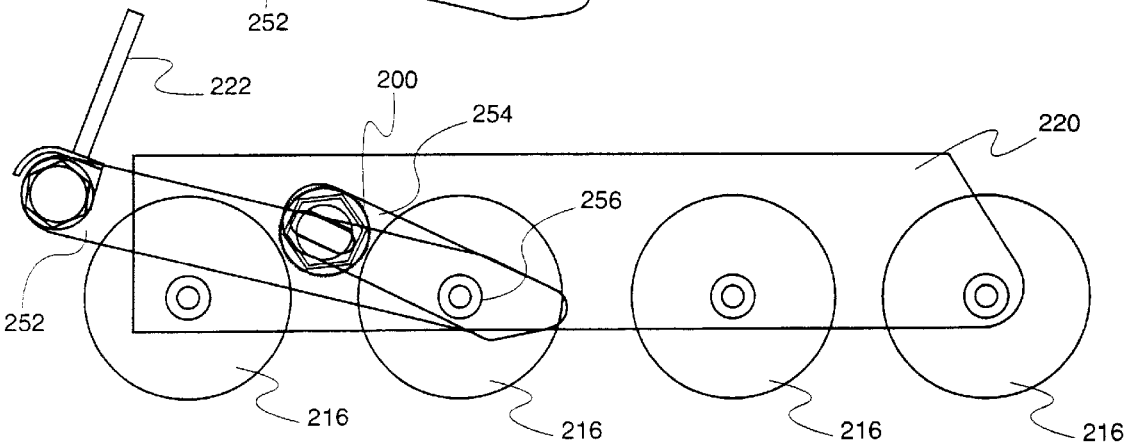
FIG - 22
FIG - 22C
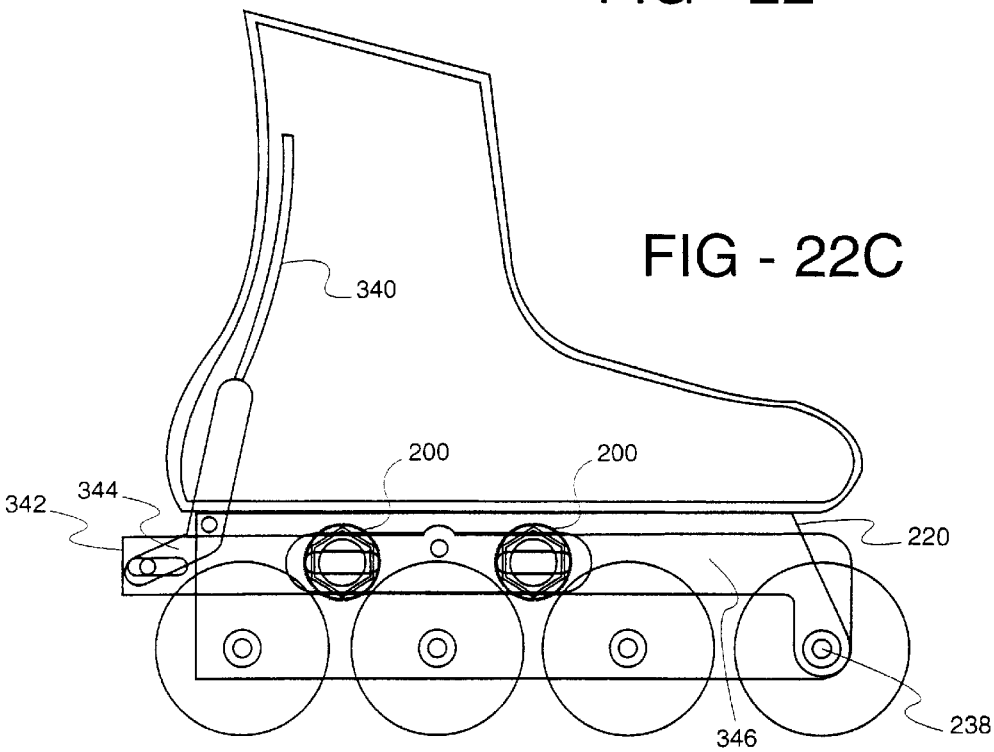

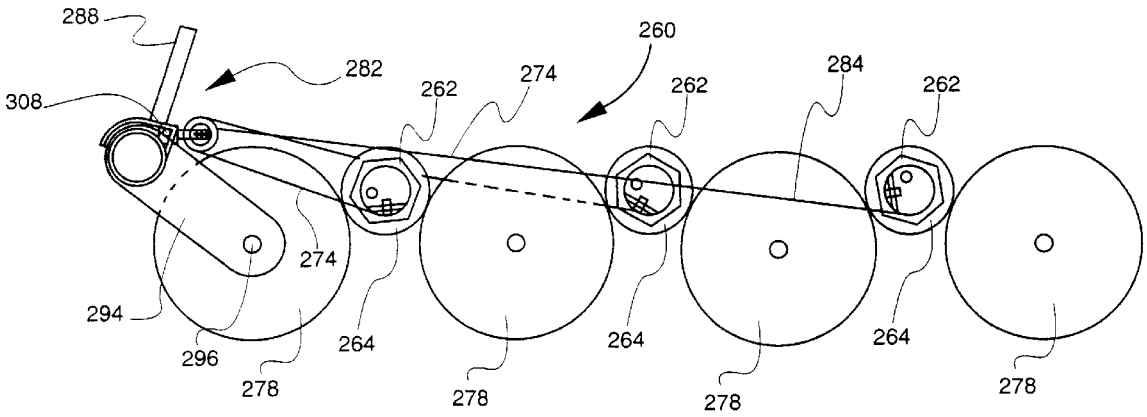
FIG - 23
FIG - 24
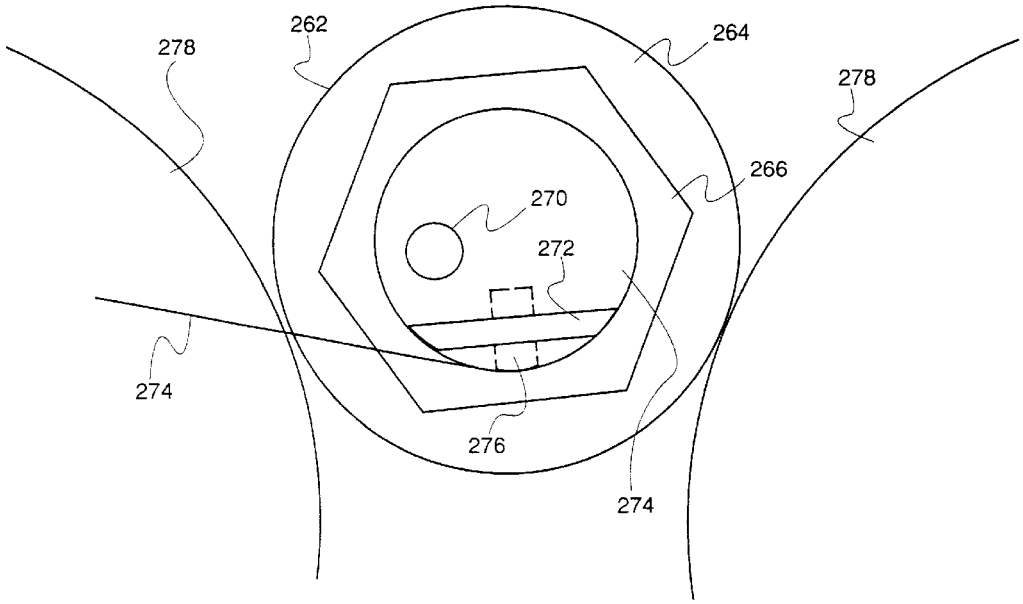

FIG - 27
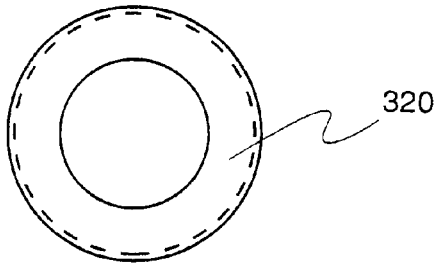
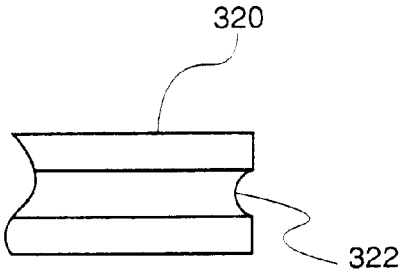
FIG - 28A
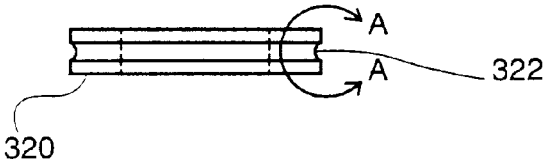
FIG - 28
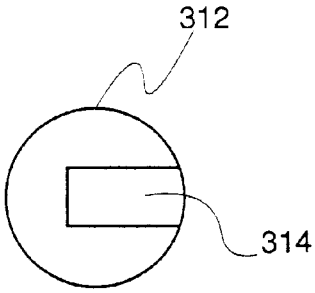
FIG - 31

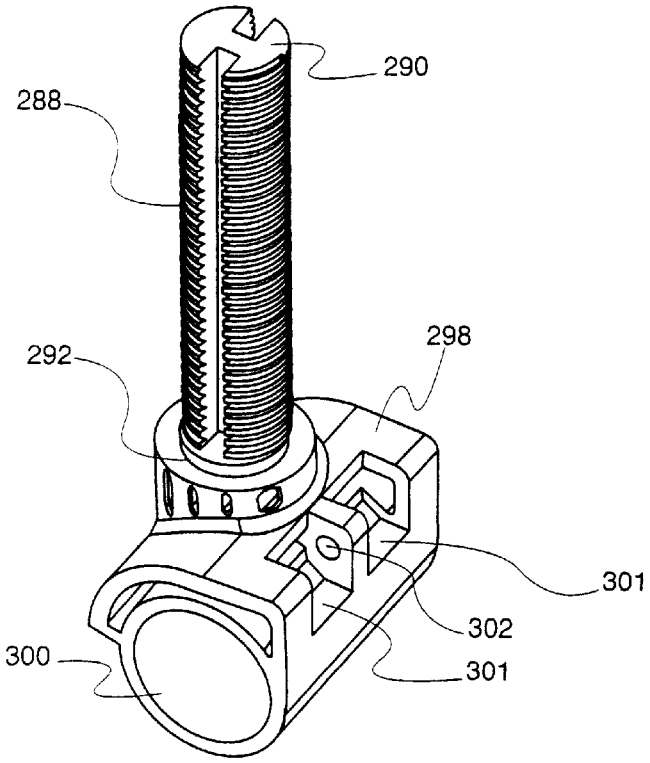
FIG - 32
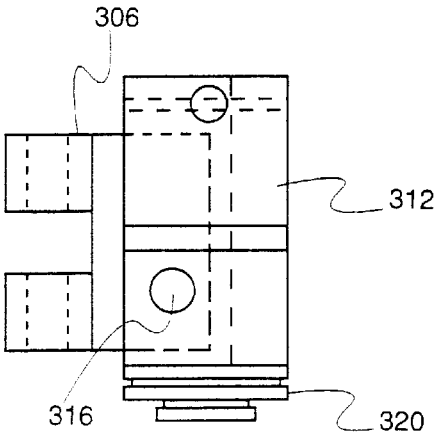
FIG - 35
FIG - 33
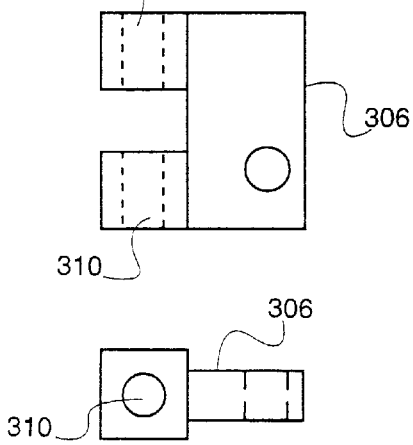
FIG - 34

FIG - 37
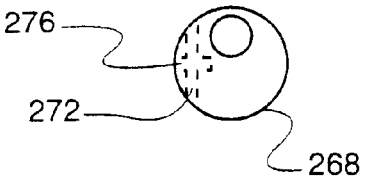
FIG - 36
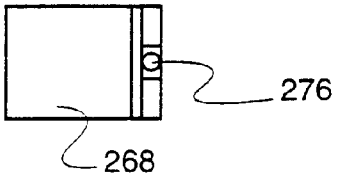
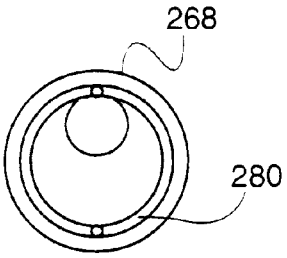
FIG - 39
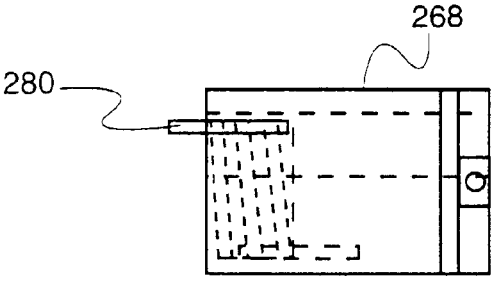
FIG - 38

SKATE BRAKE SYSTEMS AND METHODS

CROSS REFERENCE TO RELATED APPLICATION

This application is a continuation in part application of U.S. patent application Ser. No. 08/924,442, filed Aug. 26, 1997, now U.S. Pat. No. 5,829,756, which is a continuation in part application of U.S. patent application Ser. No. 08/801,858, filed Feb. 18, 1997, now U.S. Pat. No. 5,836, 590. The complete disclosures of all these applications are incorporated by reference.

BACKGROUND OF THE INVENTION

This invention relates generally to the field of roller skates. More particularly, this invention relates to a roller skate brake which slows or stops the skate by engaging at least one of the wheels while preventing heat energy that is created from slowing the wheel from transferring to the wheel.

Traditional roller skates, having set the wheels in tandem, have long been used in the relatively controlled environment of a skating rink. In a skating rink, the skating surface is typically flat and smooth, and skaters travel in the same direction around an oval or circular track. Hence, there are few unexpected hazards. Therefore, there has been little need for an effective brake on the traditional roller skate.

Recently, however, a faster and more maneuverable type of roller skate has been introduced. Such skates, known as "in-line" skates with wheels mounted in line rather than in tandem can function similar to an ice skate. In-line skates are offered in the United States by several vendors, including Rollerblade, Variflex, Bauer, and Ultra Wheels. In-line skates appeal to the athletic old and young adults and hence persons who enjoy the outdoors. Such skates are commonly used outside, on uneven sidewalks, bicycle paths, and roads. One appealing feature of the in-line skates is the high speed that can be achieved. However, this may become hazardous to the skater and others when skating more rapidly than conditions allow. Hence, a variety of brakes for in-line skates have been proposed.

One proposed brake for in-line skates involves a thick friction pad that extends behind the heel of the skate. The thick friction pad is disposed above the skating surface and is made to swing down towards the skating surface by the skater's pivoting the skate about the axis of the rear wheel. As the skater raises the toe of the skate and rotates the heel downward, the friction pad behind the heel will contact the ground and stop the skate. Brake systems have also been used on tandem wheel skates which may also include (because the speeds are not so high with tandem wheel skates) a fixed friction pad that extends in front of the toe of the skate. In this case, the skater brings the friction pad to bear on the skating surface by raising the heel and lowering the toe. Such brake systems require either the toe to be raised or lowered suffer from a number of serious drawbacks including skater fatigue in operating the brake and difficulty in maneuvering the skate to engage the brake with the skating surface.

One particularly useful type of brake which does not require the toe to be raised or lowered is a mechanically activated brake which engages the ground to slow or stop the brake as described in U.S. Pat. Nos. 5,211,409; 5,253,882; 5,316,325; 5,330,207; 5,564,718, the complete disclosures of which are incorporated herein by reference. Such a brake system includes a carriage that pivots about the rear of the skate so as to bring the brake pad into contact with the skating surface when activated by an actuator which does not require either the heel or the toe to be lowered.

Another useful type of braking system is described in U.S. Pat. Nos. 5,649,715 and 5,651,556, the disclosures of which are herein incorporated by reference. This braking system employs a sliding brake which slides relative to the skate frame to bring a braking pad into ground engagement.

Although some of such braking systems which engage a braking pad with a skating surface have proven to be generally successful in slowing or stopping the roller skates, it would be desirable to provide a braking system for a roller skate where ground engagement is not needed. In this manner, the need to place a pad on the ground to slow or stop a skate will be eliminated. This in turn, will provide improved control since the skater will not have a braking pad engaging the ground while slowing or stopping the skate. Further, it will eliminate the interference of the brake with the toe of the other foot when performing cross-overs, a skating maneuver in which one skate is placed in front of the other skate. Moreover, elimination of a bulky braking pad will make the skate more aesthetically pleasing. Some previously proposed braking systems have employed a brake pad which directly engages the wheel to slow or stop the skate. However, such a configuration is undesirable in that heat is created directly on the wheel's surface when the braking pad engages the wheel. Such heat may cause the wheels to melt, particularly since many wheels are now commonly constructed of urethane. Another problem is that such direct engagement may cause excessive wear to occur on the wheel surface.

Hence, for these and other reasons, it would be desirable to provide a skate braking system which will slow or stop a skater without engaging a brake pad with the ground and without excessively heating the wheels of the skate. Among other advantages, such braking system should be relatively easy to use and should not be bulky so as to interfere with the skater's movements.

SUMMARY OF THE INVENTION

The invention provides braking systems and methods for slowing or stopping a roller skate. In one exemplary braking system, at least one braking surface is spaced apart from a plurality of wheels. A means is provided between the braking surface and at least one of the wheels of slowing or stopping the wheel, such that heat generated when slowing or stopping the wheel is created at the braking surface and is substantially prevented from reaching the wheel.

The braking system will be particularly useful when the wheels of the roller skate are in line with each other. When the wheels are in line with each other, the means for slowing or stopping is preferably positioned between two of the in line wheels so that one or more of the wheels may be slowed or stopped at substantially the same time. In one particularly preferred embodiment, the means of slowing or stopping comprises a rotatable member which may be positioned to contact at least one of the wheels when rotating. When the rotatable member is positioned against the wheel, the rotatable member will freely rotate. A portion of the rotatable member is then engaged with the braking surface to gently slow rotation of the rotatable members. Since the rotatable member is in contact with the wheel, as the rotatable member is slowed by the braking surface, the wheel will also slow. Preferably, the rotatable member will be engaged with the wheel such that no slippage will occur between the wheel and the rotatable member. In this way, little or no heat will be generated at the interface between the wheel and the rotatable member. Hence, with such a configuration, rotation of the wheel will be gently slowed while the heat generated between the braking surface and the rotatable member will be away from the wheel so as to not damage the wheel. Further, since the rotatable member is spaced apart from the wheels until actuated, no additional friction is applied to the wheels when actively skating or gliding. In this way, the wheels may efficiently turn until the brake is applied.

In another aspect of the system, an actuator is provided which positions the rotatable member against the wheel and also engages the braking surface with the rotatable member. One particularly preferable actuator comprises a cam or a pivotable brake arm which moves the rotatable member into contact with one or more wheels upon rotation of the cam or pivoting of the brake arm. A variety of mechanisms can be employed to rotate the cam or pivot the brake arm including a cable, a rod, an air cylinder, a hydraulic cylinder, a lever, and the like. Such mechanisms may in turn be connected to the cuff of the boot or to an elongate member (such as shown in FIG. 33, of U.S. Pat. No. 5,704,619, the disclosure of which is herein incorporated by reference), so that movement of the skater's leg may rotate the cam or pivot the brake arm.

In one particular embodiment, the invention provides a braking unit which slows or stops the wheels by direct engagement with at least one wheel without creating substantial heating of the wheel. The braking unit comprises a friction hub, an elastomeric or rubber pad having an inner core or surface, and a wheel engaging hub which are assembled together. When the braking unit is engaged between a pair of wheels by a force, the wheel engaging hub is compelled to rotate by the turning wheel of the skate, similar to the engagement of gears with one another. As the wheel engaging hub rotates, the rubber pad is rotated at the same rate by virtue of it's engagement within the wheel engaging hub (engagement of the rubber pad may be facilitated by virtue of a hexagonal cross-section of the rubber pad and a mating hexagonal bore within the wheel engaging hub). Braking results when the inner bore of the rubber pad rotates around the friction hub. The friction hub, which is constrained not to rotate, provides a friction surface for the rubber pad. The surface texture of the friction hub, combined with the compound type and hardness of the rubber pad, serve to resist the turning motion of the skate wheels. This resistive torque is transmitted through the wheel engaging hub and to the turning wheels, slowing the skate to which the wheels are attached.

The rate of convective, conductive, and radiant heat transfer may be enhanced in a number of ways. Specific examples include convectively cooling the wheel engaging hub and friction hub by increased surface area, such as might be achieved by way of a multitude of holes through the friction hub and wheel engaging hub. They may also be cooled by a turbine fan, or by a liquid contained within the friction and wheel engaging hubs. Radiant cooling could be enhanced by way of a dark surface finish of the brake components. Conductive cooling might be achieved through some form of intimate contact between a skate component such as a metallic wheel rack and one or more metallic braking components. Optionally, a piece of insulation may be placed between the wheel engaging hub and the elastomeric pad in order to reduce heat transfer back to the skate wheel(s).

A variety of activation methods may be employed to activate the brake unit. For example, a cuff or an elongated member as shown in FIG. 33 of U.S. Pat. No. 5,704,619 may be employed to activate either a rod, a lever, a cable or the like. Such mechanisms may be used to activate one or more engaging hubs to stop one or more wheels. The amount of braking produced may be varied by providing additional braking units, altering the friction surface of the friction hub, and altering the durometer of the elastomeric member.

Another method of activation is achieved by using a cuff or elongated member to activate an eccentric pivot in the braking unit via a cable, a lever, a rod or the like. This method can be used to activate one or more engaging hubs to stop one or more wheels.

The invention further provides a braking system for roller skates having a plurality of in-line wheels which rotate from the roller skate when rolling over a skating surface. The system comprises a rotatable member which may be positioned to contact at least one of the wheels when rotating. When the rotating member is positioned against the wheels, the rotatable member rotates. A braking surface is provided and is engageable with the rotatable member so that as the rotatable member engages the braking surface, the rotatable member will be slowed which in turn gently slows rotation of the in-line wheel.

In a preferable aspect, the rotatable member may be positioned to contact two of the in-line wheels at substantially the same time. In this manner, both of the wheels will be slowed at substantially the same rate thereby preventing one of the wheels from "locking up". In another aspect, at least a portion of the rotatable member is thermally conductive so that heat generated between the rotatable member and the braking surface may be dissipated into the atmosphere before reaching the wheels. An exemplary material for constructing the rotatable member is aluminum. A plurality of heat transfer ribs may also be provided on the rotatable member to assist in dissipating the heat. The rotatable member may also include insulation, such as a ceramic material, for preventing heat generated at the braking surface from transferring to the wheel.

In yet another aspect, an actuator is provided which positions the rotatable member against the wheel and engages the braking surface with the rotatable member. One particularly preferable actuator is a cam which may be rotated within a groove of an elastomeric housing. The braking surface is formed within the housing, and the rotatable member is rotatably attached to the housing so as to be spaced apart from the braking surface. In this way, rotation of the cam forces the braking surface against the rotatable member after the rotatable member has moved into contact with the wheels. Usually, the cam will be rotatably connected to a skate frame.

In one particular embodiment, the rotatable member has an engaging surface which moves against a braking surface upon rotation of the rotatable member by the wheel. In one aspect, the engaging surface is included on an axle of the rotatable member. With such an arrangement, the braking surface preferably comprises a liner that is at least partially disposed about the axle. In this way, the liner is employed to frictionally slow the rotatable member upon rotation of the rotatable member by the rotating wheel. In another particular aspect, the liner is attached to a braking arm which is pivotally coupled to a frame of the skate. The liner includes an opening through which the axle is held so that when the arm is pivoted, the rotatable member is moved into contact with the wheel and the axle is forced against the liner. As the force is increased, the amount of friction between the axle and the liner is increased to more rapidly slow rotation of the rotatable member and the wheel which is in contact with the rotatable member. In a particularly preferable aspect, the system includes a pair of spaced apart arms, with each arm including a liner having an opening. The rotatable wheel engaging member is positioned between the arms, with the axle being held within the openings.

In yet another aspect, the system further includes a brake pad and a feeding mechanism to maintain the brake pad in contact with the rotatable member. The brake pad may be employed as the only braking surface to slow or stop rotation of the rotatable member, or, alternatively, may be used in combination with one or more liners which are disposed about an axle of the rotatable member as just described. The brake pad preferably includes a cylindrical surface which is in contact with the rotatable member. Conveniently, the brake pad may be held within a housing, with the feeding mechanism comprising a spring that is disposed between the housing and the brake pad. In this way, the brake pad is maintained against the rotatable member so that a fresh supply of braking surface will always be maintained against the rotatable member. The housing is preferably coupled to the brake arm in a manner such that the brake pad is disposed on top of the rotatable member. In this way, as the brake arm forces the rotatable member against the rotating wheel, the rotatable member is forced against the brake pad to increase the amount of friction supplied to the rotatable member. Another particular advantage of the brake pad is that it may be easily removed from the housing and replaced with a new brake pad if the initial brake pad has experienced excessive wear.

The invention further provides a roller skate comprising a brake and a frame which connects a plurality of in-line wheels to the boot. A braking surface is operably attached to the frame, and a means is provided between the braking surface and at least one of the wheels for slowing or stopping the wheel. The means for slowing or stopping is configured so that heat generated when slowing or stopping the wheel is created at the braking surface and is substantially prevented from reaching the wheel.

The invention provides an exemplary method for slowing or stopping a moving roller skate. According to the method, a rotating wheel of the roller skate is contacted with a rotatable member. The rotatable member is then slowed such that heat energy created in slowing the rotatable member is substantially prevented from reaching the wheel. The rotatable member is preferably gently slowed so that no jerking action will result when slowing or stopping the wheel. The rotatable member is preferably slowed by positioning a braking surface against the rotatable member such that substantially no slippage is created between the wheel and the rotatable member.

In another aspect of the method, the roller skate preferably includes an elastomeric housing having the braking surface formed therein, and the rotatable member being rotatably attached to the housing so as to be spaced apart from the braking surface. In this manner, a rotatable member may be positioned against the braking surface by compressing the housing to force the braking surface against the rotatable member after the rotatable member contacts the wheel and begins to spin at the same surface rate as that of the wheel. The braking surface will preferably be positioned against the rotatable member by rotating a cam. An exemplary aspect, rotation of the cam will result from rotating a cuff on a roller skate.

The invention further provides an exemplary method for slowing or stopping a moving roller skate. According to the method, a rotating wheel of the roller skate is contacted with a rotatable member such that the rotatable member begins to rotate. The rotatable member is frictionally slowed by contacting a braking surface against at least a portion of the rotatable member to slow or stop the wheel.

In one particular aspect, the braking surface is forced against an axle of the rotatable member to slow or stop the wheel. Preferably, the braking surface comprises a liner that is disposed about the axle, with the liner being included in a brake arm. In this manner, the brake arm is moved to engage the rotatable member against the wheel, causing initial rotation of the rotatable member and subsequent contact between the rotating braking surface and the axle.

In another aspect, the braking surface comprises a brake pad that is biased against the rotatable member. In this way, the brake pad is fed against the rotatable member so that a continuous supply of braking surface is available. Preferably, the brake pad is held within a housing to facilitate easy removal and replacement of the brake pad. Conveniently, a cuff on the roller skate may be rotated to move the brake arm.

BRIEF DESCRIPTION OF THE DRAWINGS

FIG. 20 shows an alternative embodiment of the system of FIG. 19.

FIG. 20A illustrates a brake arm of the system of FIG. 20.

FIG. 20B illustrates a linkage attachable to the brake arm of the system of FIG. 20.

FIG. 21 illustrates a further alternative embodiment of a braking system of FIG. 19.

FIG. 21A illustrates a brake arm of the system of FIG. 21.

FIG. 21B illustrates a first linkage which is attachable to the brake arm of the system of FIG. 21.

FIG. 21C illustrates a second linkage which is attachable to the first linkage of FIG. 21B.

FIG. 22 illustrates still a further embodiment of a braking system employing the assembled braking unit of FIGS. 17A and 17B.

FIG. 22A illustrates a first linkage of a brake arm of the braking system of FIG. 22.

FIG. 22B illustrates a second integral linkage of the brake arm of the braking system of FIG. 22.

FIG. 22C illustrates a braking system employing a paddle to initiate braking action according to the invention.

FIG. 23 illustrates yet another embodiment of a braking system employing an eccentric pivot according to the invention.

FIG. 24 is a more detailed view of a brake unit of the system of FIG. 23.

FIG. 27 is a side view of a spool employed in the braking system of FIG. 23.

FIG. 28 is a top view of the spool of FIG. 27.

FIG. 28A is a more detailed view of the spool of FIG. 28 taken along lines A—A.

FIG. 31 is an end view of the pivot member of FIG. 30.

FIG. 32 is a perspective view of the activation mechanism of FIG. 26.

FIG. 33 is a top view of a link member employed by the braking system of FIG. 23.

FIG. 34 is a side view of the link member of FIG. 33.

FIG. 35 illustrates the link member of FIG. 33 and spool of FIG. 28 attached to the pivot member of FIG. 29.

FIG. 36 is a side view of a friction hub employed by the braking system of FIG. 23.

FIG. 37 is an end view of the friction hub of FIG. 36.

FIG. 38 illustrates the friction hub of FIG. 36 with a spring loading.

FIG. 39 is an end view of the friction hub of FIG. 38.

DETAILED DESCRIPTION OF THE SPECIFIC EMBODIMENTS

The invention provides braking systems and methods for slowing or stopping a roller skate without engaging a braking pad with the skating surface and without generating a significant amount of heat on the wheels of the skate when the skate is being slowed or stopped. Although the systems and methods may be used with virtually any type of roller skate, they will find their greatest use with in-line roller skates.

Figure 1:
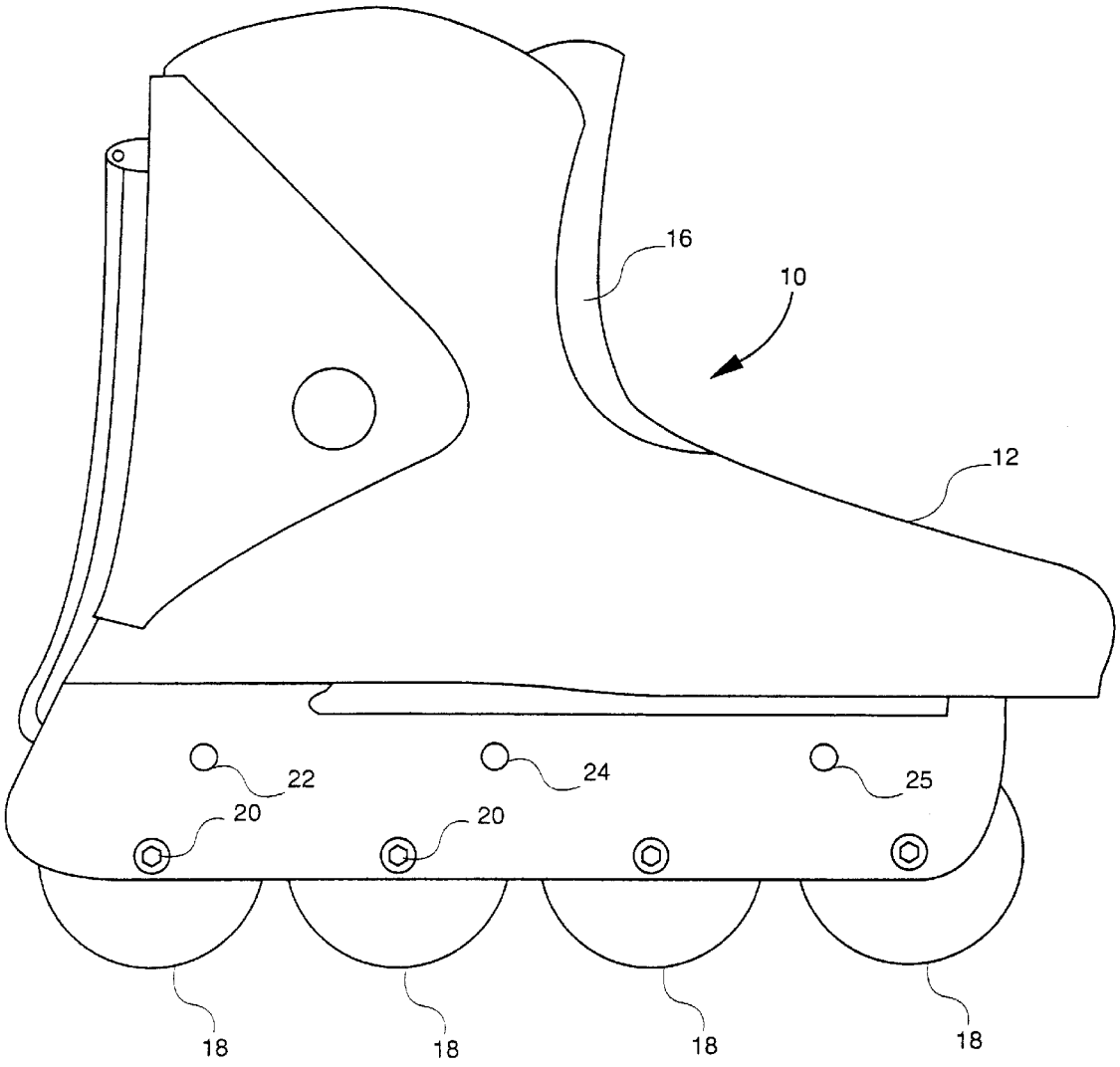
FIG. 1 is a side view of a roller skate having a braking system according to the present invention.

Referring now to FIG. 1, an embodiment of an in-line roller skate 10 which may incorporate braking systems according to the present invention will be described. Skate 10 includes a boot 12 and a frame 14 attached to or integrally formed with boot 12. Boot 12 may optionally include a rotatable cuff 16 which may be employed to actuate braking systems of the invention as described in greater detail hereinafter. Frame 14 holds a plurality of wheels 18 in line with each other and along a longitudinal axis of the skate. Wheels 18 are held to frame 14 by axles 20. Frame 14 further includes a pair of mounting holes 22 and 24 for mounting a braking system as described next with reference to FIGS. 2 and 3.

Figure 2:
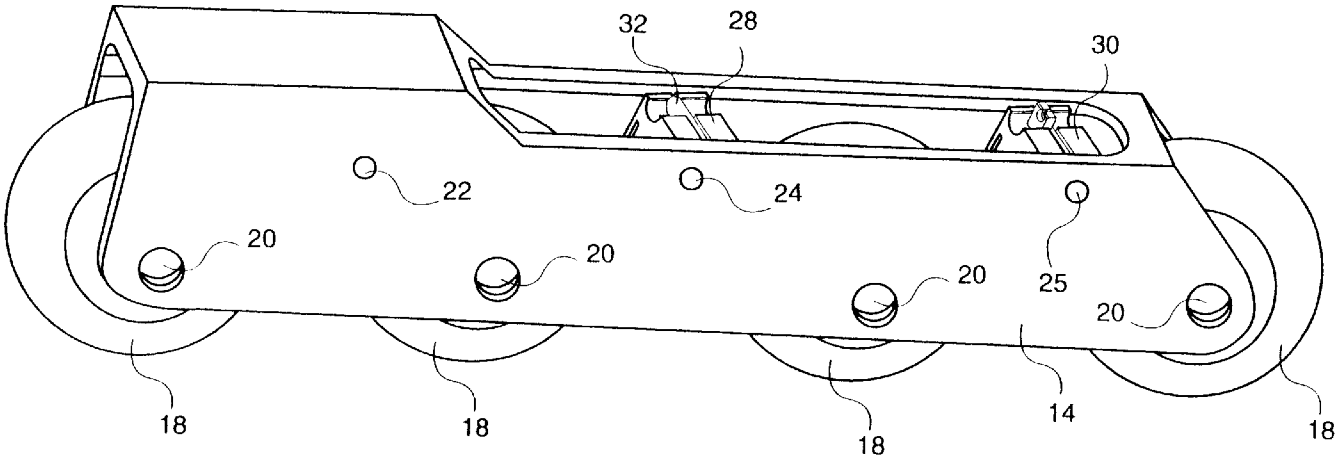
FIG. 2 is a perspective view of a frame of the roller skate of FIG. 1 which holds a plurality of wheels and the braking system.
Figure 3:
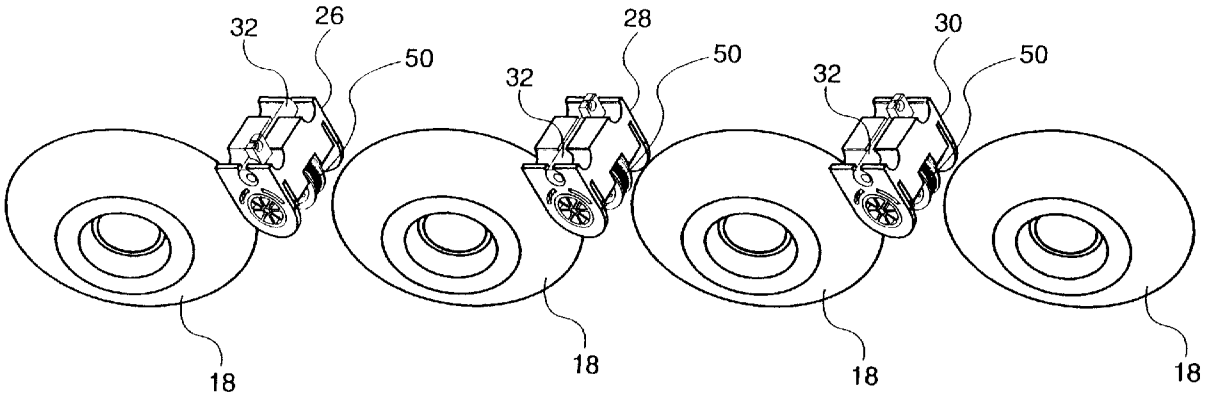
FIG. 3 is a perspective view of the wheels and the braking system of FIG. 2 with the frame shown removed.

Referring now to FIGS. 2 and 3, frame 14 holds a set of braking units 26, 28 and 30 above wheels 18. Although three braking units are shown, it will be appreciated that only one or two braking units may be included on a skate. Braking unit 26 is attached to frame 14 at mounting hole 22, braking unit 28 is attached to frame 14 at mounting hole 24, and braking unit 30 is attached to frame 14 at mounting hole 25. Braking units 26, 28 and 30 are held by frame 14 such that each braking unit is positioned in between and above two of the wheels 18 as shown. Braking units 26, 28 and 30 are attached to frame 14 by pins (not shown) extending through an eccentric cam 32 and terminating in mounting holes 22, 24, and 25, respectively.

Figure 4:
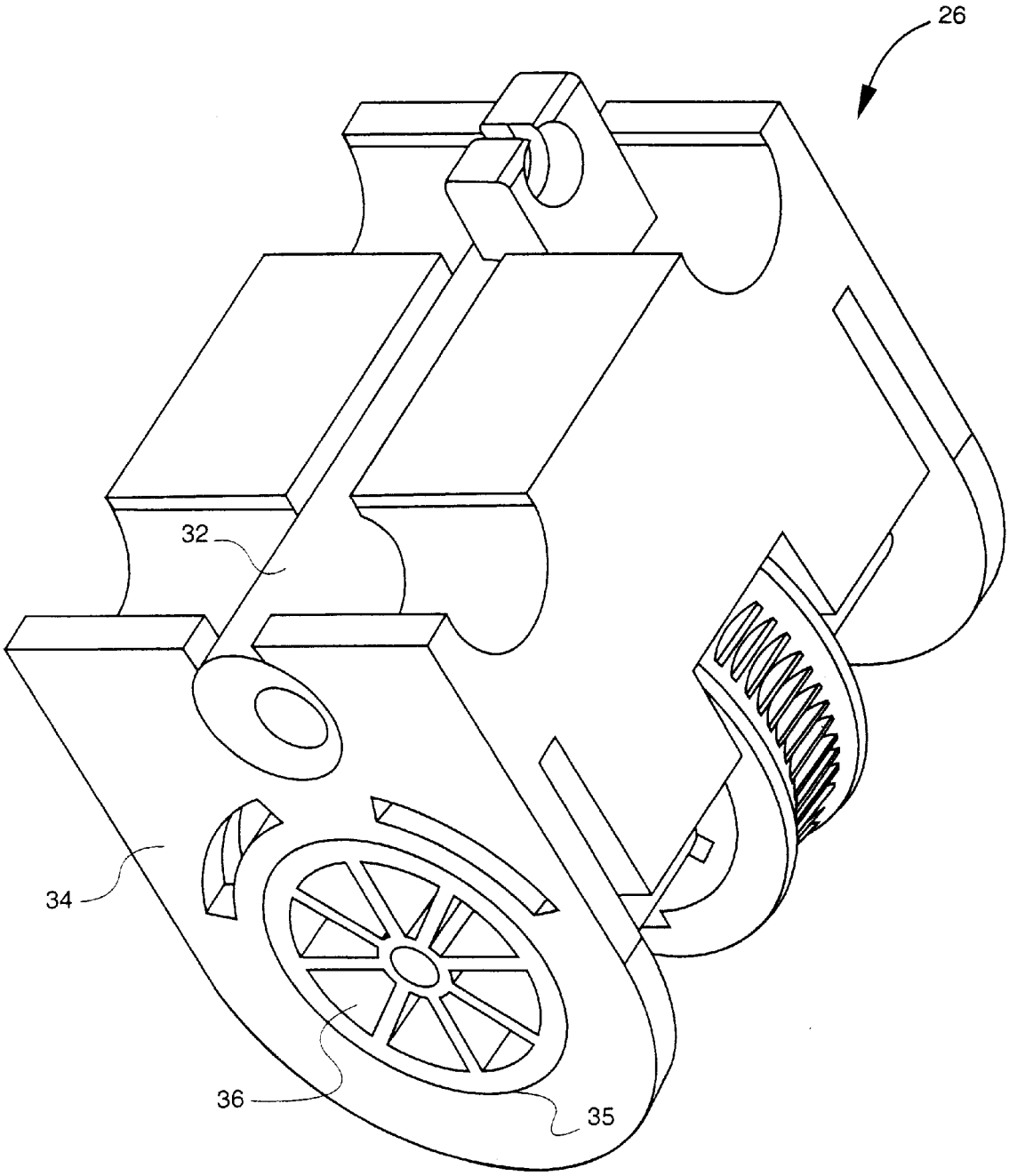
FIG. 4 is a perspective view of a braking unit of the braking system illustrated in FIGS. 2 and 3.
Figure 5:
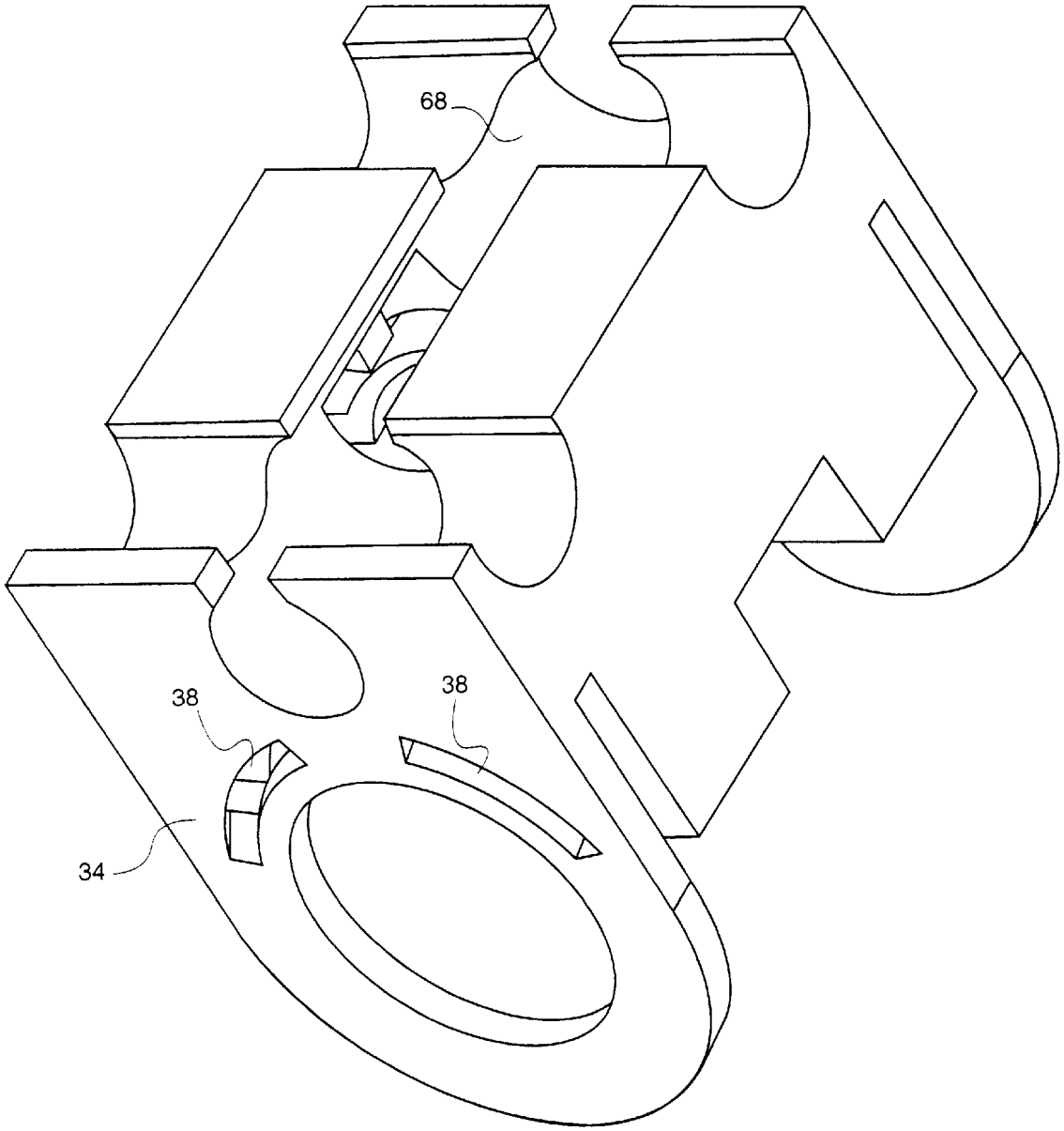
FIG. 5 is a perspective view of an elastomeric housing of the braking unit of FIG. 4.
Figure 6:
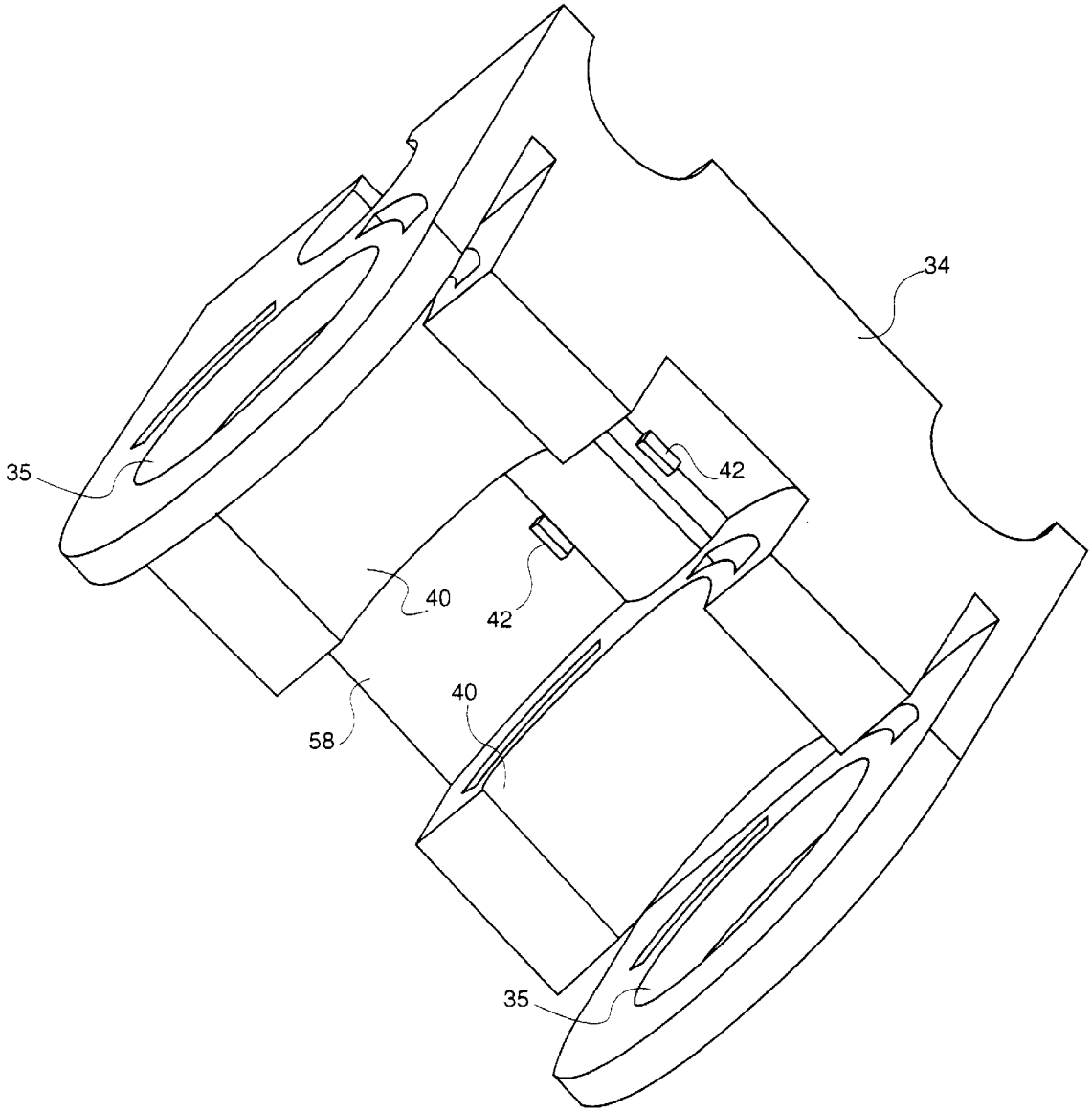
FIG. 6 is a perspective view of the elastomeric housing of FIG. 5 showing a pair of braking surfaces.

Referring to FIG. 4, construction of braking unit 26 will be described in greater detail, it being understood that braking units 28 and 30 are essentially identical to braking unit 26. Braking unit 26 comprises an elastomeric housing 34 which rotatably receives cam 32 and rotatable member 36. Elastomeric housing 34 is shown separately in FIGS. 5 and 6. Elastomeric housing is preferably constructed of an elastomer, such as rubber, so that housing 34 will be able to compress at slit 38 (see FIG. 5) and to withstand heat created at braking surfaces 40 (see FIG. 6) as described hereinafter. Tabs 42 may optionally be provided as auditory wear indicators to indicate when braking surfaces 40 have become excessively worn.

Figure 7:
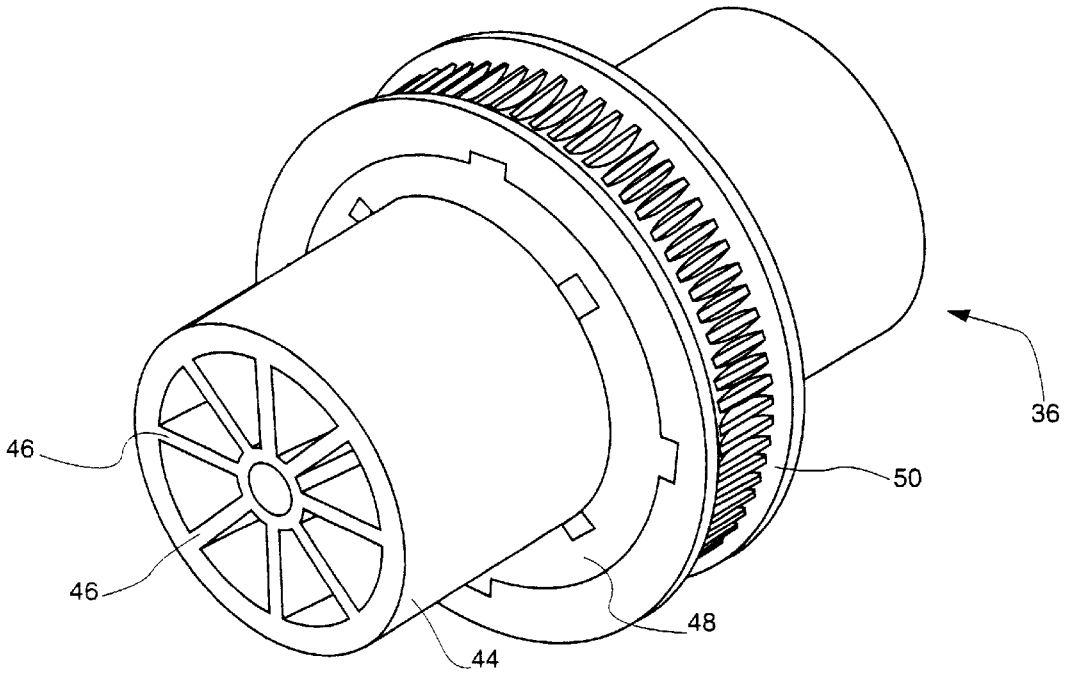
FIG. 7 is a perspective view of a rotatable member of the braking unit of FIG. 4.

Referring now to FIG. 7, construction of rotatable member 36 will be described in greater detail. Rotatable member 36 comprises a hollow shaft 44 having heat transfer fins 46. When rotatable member 36 is held within elastomeric housing 34 (see FIG. 4) shaft 44 is spaced apart from braking surfaces 40 (see FIG. 6). Shaft 44 is preferably constructed of a thermally conductive material such as aluminum, copper, steel, and the like so that heat generated between shaft 44 and braking surfaces 40 will be transferred through fins 46 and will dissipate into the atmosphere, thereby preventing the heat from reaching wheels 18 (see FIG. 1). An insulating cylinder 48 is placed around shaft 44 for preventing heat from shaft 44 from transferring through a gear 50 to wheels 18.

Figure 8:
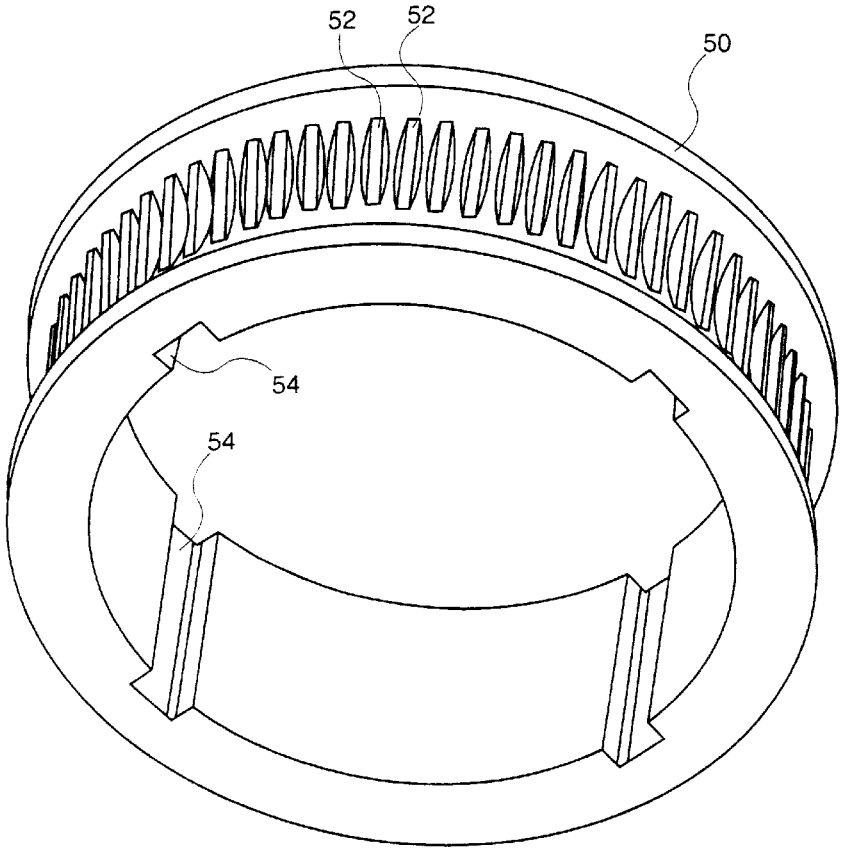
FIG. 8 is a perspective view of a gear, the rotatable member of FIG. 7.

Gear 50 is shown in greater detail in FIG. 8. Gear 50 may optionally include a plurality of ribs 52 which engage wheel 18 as described in greater detail hereinafter. Gear 50 includes a plurality of slots 54 which are received over elongate tabs 56 of insulating cylinder 48 to prevent rotation of gear 50 relative to shaft 44.

When rotatable member 36 is received in hole 35 of housing 34 (see FIG. 6) gear 50 is received into a curved slot 58 so that gear 50 will not come into contact with housing 34 except when engaging tabs 42 to indicate excessive wear of braking surfaces 40. In this manner, heat generated between braking surfaces 40 and shaft 44 will be substantially prevented from transferring to gear 50. In this manner, when gear 50 engages wheels 18 (see FIG. 2) heat will not be transferred to the wheels 18. Ribs 52 are provided on gear 50 to prevent gear 50 from slipping when engaging wheels 18 as described in greater detail hereinafter.

Figure 9:
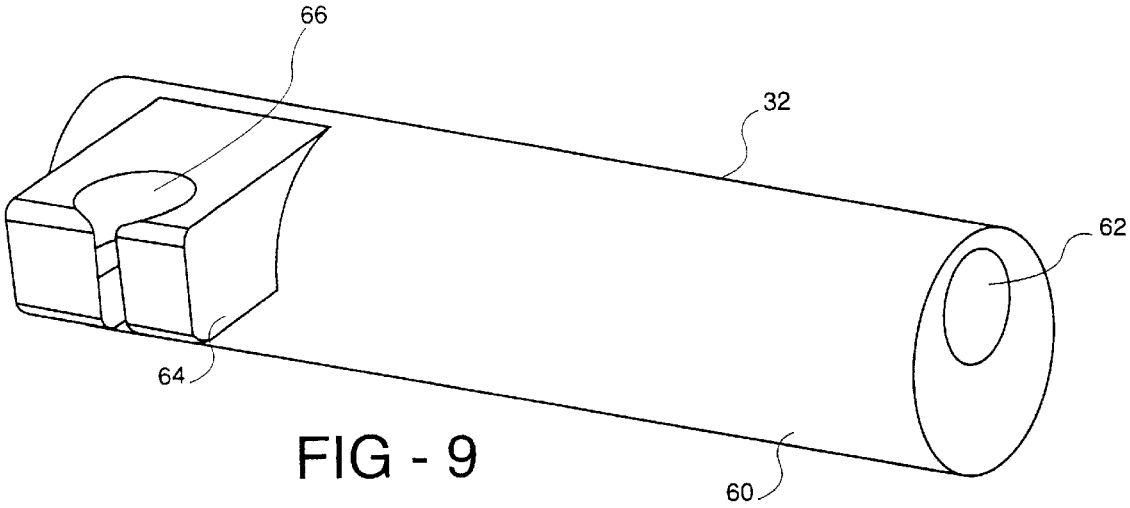
FIG. 9 is a perspective view of a cam actuator of the braking unit of FIG. 4.

Referring to FIG. 9, construction of cam 32 will be described. Cam 32 comprises an eccentric shaft 60 having a lumen 62 extending therethrough. A pin (not shown) is placed through lumen 62 to connect cam 32 to frame 14 as shown in FIG. 2. In this manner, cam 32 may be rotated relative to frame 14 when responding to a force to a lever arm 64. Lever arm 64 includes an aperture 66 to which a cable, rod, or the like may be placed to rotate cam 32. Cam 32 is rotatably received within a cylindrical opening 68 (see FIGS. 4 and 5) of housing 34. Since opening 68 is cylindrical, when cam 32 is rotated relative to housing 34, housing 34 will be directed downward relative to frame 14.

Referring back now to FIGS. 2 and 3, operation of braking units 26, 28 and 30 to slow or stop wheels 18 of skates 10 will be described. Cam 32 of braking units 26, 28 and 30 will preferably be interconnected by a cable or rod so that cam 32 of braking units 26, 28 and 30 will be rotated at the same time and rate. Cams 32 of braking units 26, 28 and 30 may be actuated by a cable or a rod extending to cuff 16 (see FIG. 1) so that as the cuff 16 is pivoted with the skater's leg, the braking system will be actuated. Other actuators include hydraulic actuators, solenoids, and the like.

Upon rotation of cam 32, elastomeric housing 34 is moved downward toward wheels 18 until gear 50 engages the pair of wheels 18 positioned below it. Preferably, gear 50 will engage both wheels above which it is positioned at substantially the same time. Further, since braking units 26, 28 and 30 will preferably be actuated at the same time, all four wheels 18 will preferably come into contact with a respective gear 50 at the same time. Rotatable member 36 is completely rotatable within holes 35 so that as gear 50 comes into contact with wheels 18, rotatable member 36 will freely rotate. In this manner, the skater will not feel a sudden jerk as gear 50 engages wheels 18. Further since rotatable member 36 may freely rotate within hole 35 of housing 34, virtually no slippage will occur between gear 50 and wheels 18. In this manner, substantially no heat will be generated between wheels 18 and gear 50.

As cam 32 is further rotated, housing 34 begins to compress at slit 38. As housing 34 compresses, braking surfaces 40 (see FIG. 5) come into contact with shaft 44 (see FIG. 7). When shaft 44 engages braking surfaces 40, shaft 44 will be rotating due to engagement with wheels 18. Housing 34 will be constructed to be sufficiently resilient so that shaft 44 will slowly and gently come into contact with braking surfaces 40 so that no jerky movements will be felt by the skater. As cam 32 continues to rotate, braking surfaces 40 will be further pressed against rotating shaft 44 to slow shaft 44. In turn, gear 50 will slow engaged wheels 18. Since gear 50 includes ribs 52, gear 50 will not slip relative to wheels 18 to provide a smooth slowing of wheels 18.

The heat generated between shaft 44 and braking surfaces 40 will be transferred through fins 46 and dissipated into the atmosphere. Insulating cylinder 48 will substantially prevent any heat from transferring to gear 50 so that the heat created at the braking surfaces 40 will be substantially prevented from reaching wheels 18 and causing damage thereto.

Since braking units 26, 28 and 30 may be configured to equally engage all of the wheels 18 by employing a force balancing mechanism as described hereinafter with reference to FIG. 9A, wheels 18 will generally be slowed at about the same rate and at about the same time. In this manner, one or more of the wheels will not prematurely lock up. Rather, all of wheels 18 will slow equally.

When the skater has sufficiently slowed or stopped, cams 32 are rotated in the opposite direction to lift braking units 26, 28 and 30 from wheels 18 so that wheels may freely rotate.

A variety of schemes may be employed to move braking units 26, 28 and 30 into wheel engagement. One such system is illustrated in FIGS. 9A–9D. As shown in FIG. 9A, cables 300, 302 and 304 are attached to cams 32 of each of the braking units. Cables 300, 302 and 304 are attached at their opposite ends to arms 307 and 309 of a holding element 306 having a rotatable wheel 308. More specifically, cable 300 is attached to arm 307 and cables 302 and 304 are attached to arm 309. Arms 307 and 309 are off-set from a central axis of holding element 306 such that when holding element 306 is moved away from wheels 18, a generally equal force will be applied to cables 300, 302 and 304. In this way, holding element 306 and arms 307 and 309 function as a force balancing mechanism equally tension each of the cables.

Figure 9B:
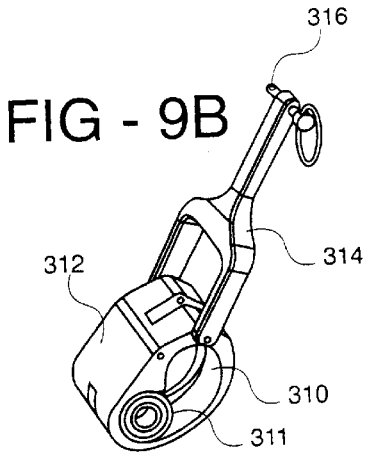
FIGS. 9A–9D are perspective views of an alternative actuation system employed to operate the braking units of FIG. 4.
Figure 9A:
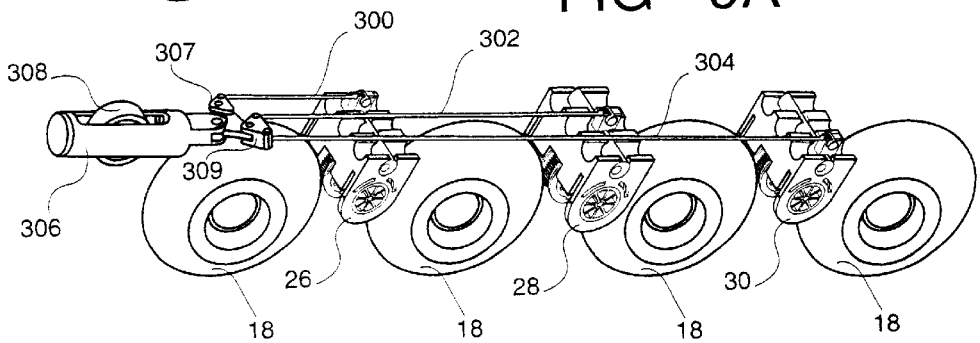
Figure 9C:
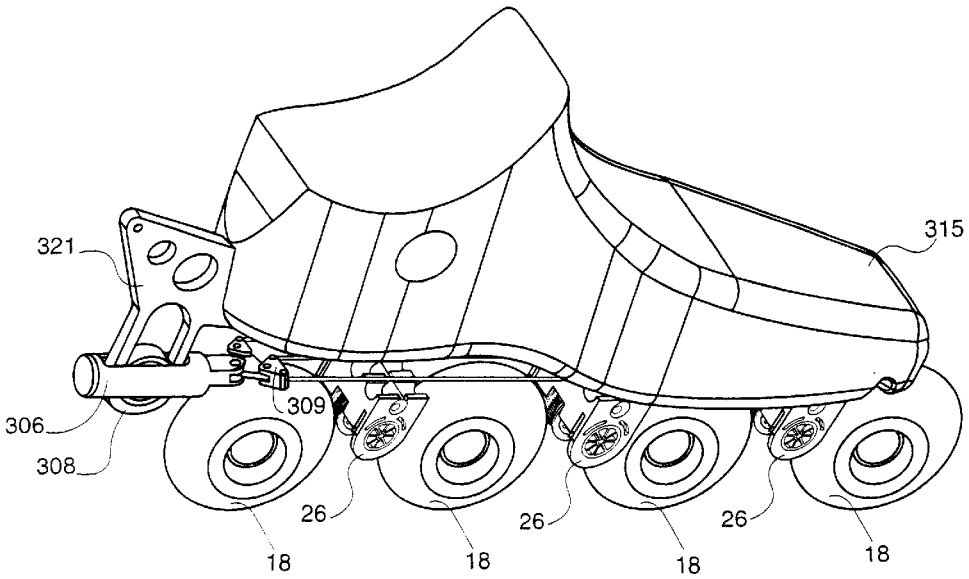
Figure 9D:
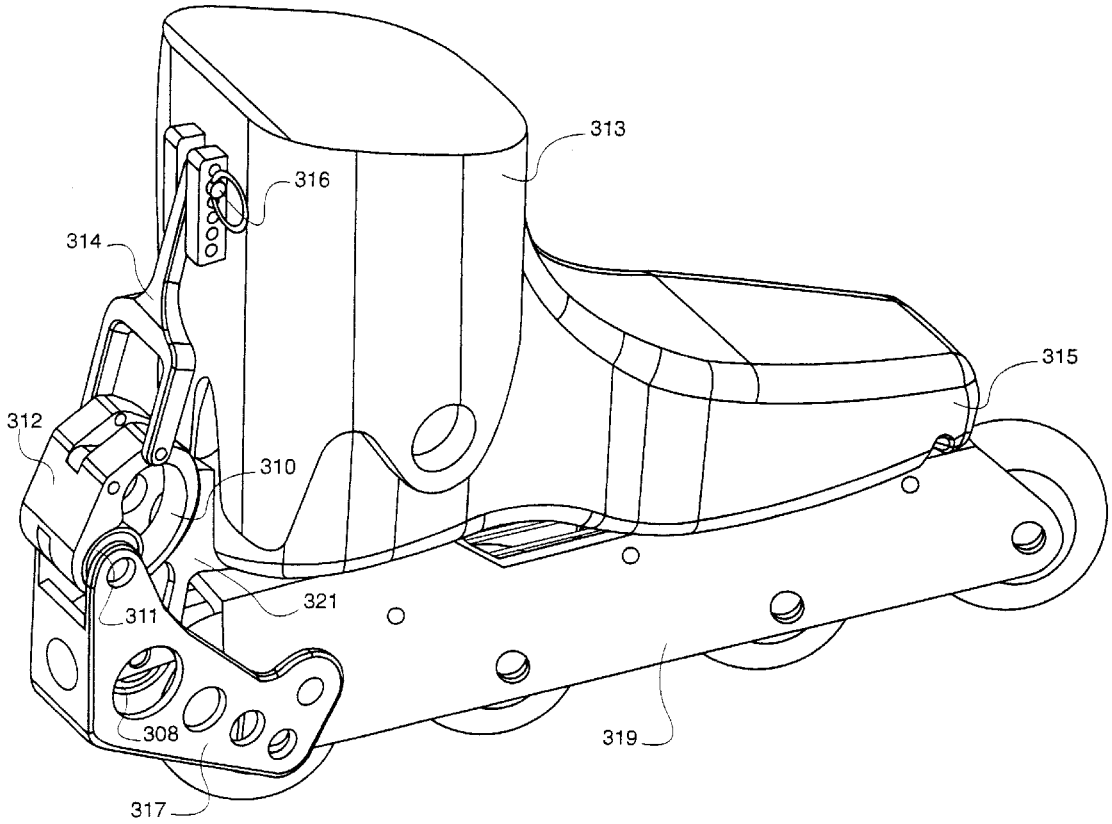

As illustrated in FIGS. 9B–9D, a wheel 311 rests in a bean shaped aperture 310 of a slidable member 312 which in turn is pivotally attached to a rod member 314. A pin 316 is provided to attach rod member 314 to a cuff 313 of a boot 315. Wheel 311 is coupled to a bracket 317 which in turn is coupled to a frame 319 of the skate. Coupled to slidable member 312 is an extension member 321 which extends from boot 315. Extension member 321 includes an angled slot into which wheel 308 is received. In this way, when the skater moves cuff 313 (or leans back in boot 315 to move the heel of boot 315 toward frame 319), rod member 314 is lowered to move slidable member 312 downward. This movement causes extension member 321 to move downward. The angled nature of the slot then causes holding element 306 to move backward to tension cables 300, 302 and 304 and move braking units 26, 28 and 30 into wheel engagement. When rod member 314 is moved upward, the tension in the cables is released and the braking action stops.

Figure 10:
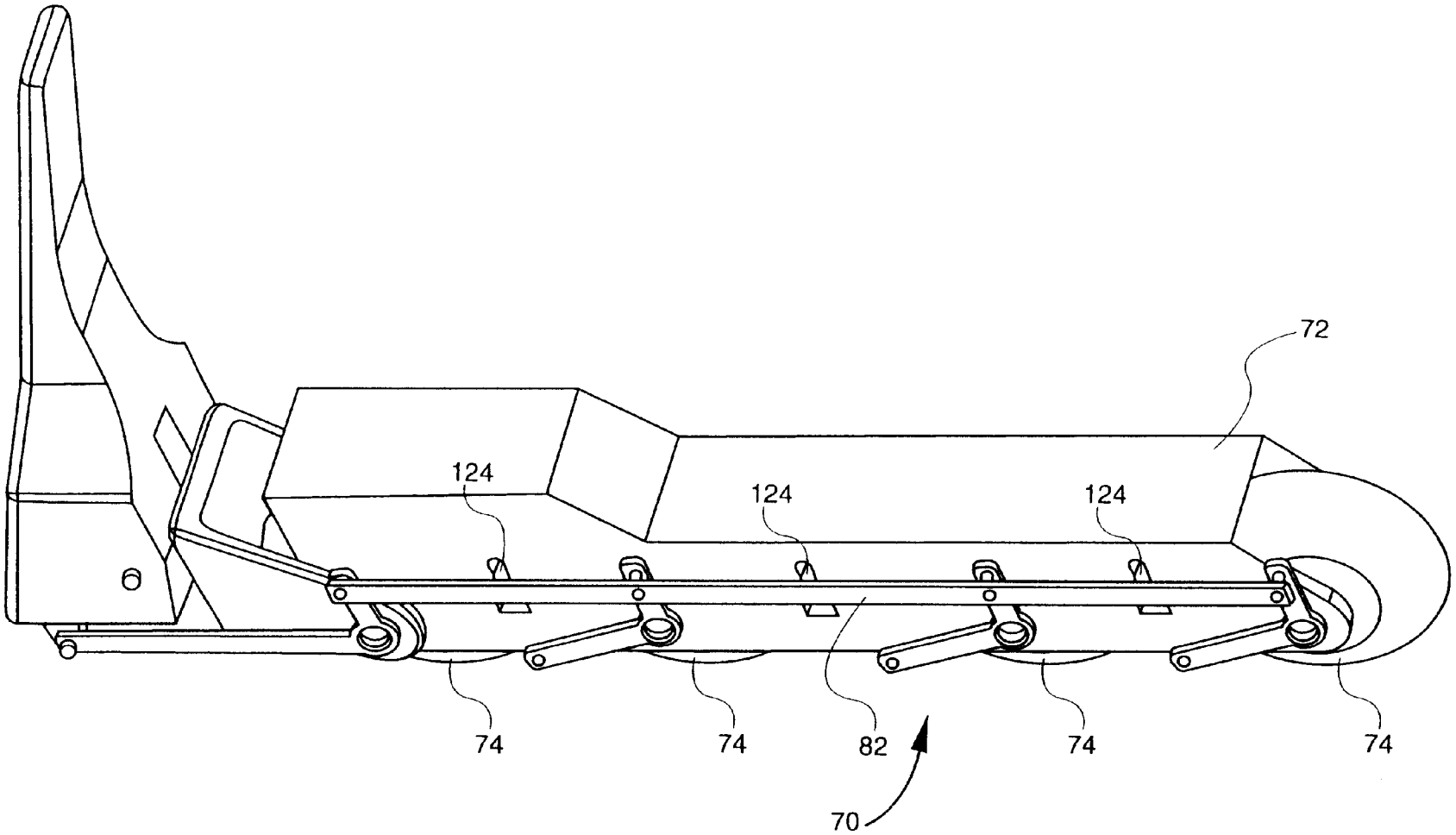
FIG. 10 is a perspective view of an alternative embodiment of a braking system according to the present invention.
Figure 11:
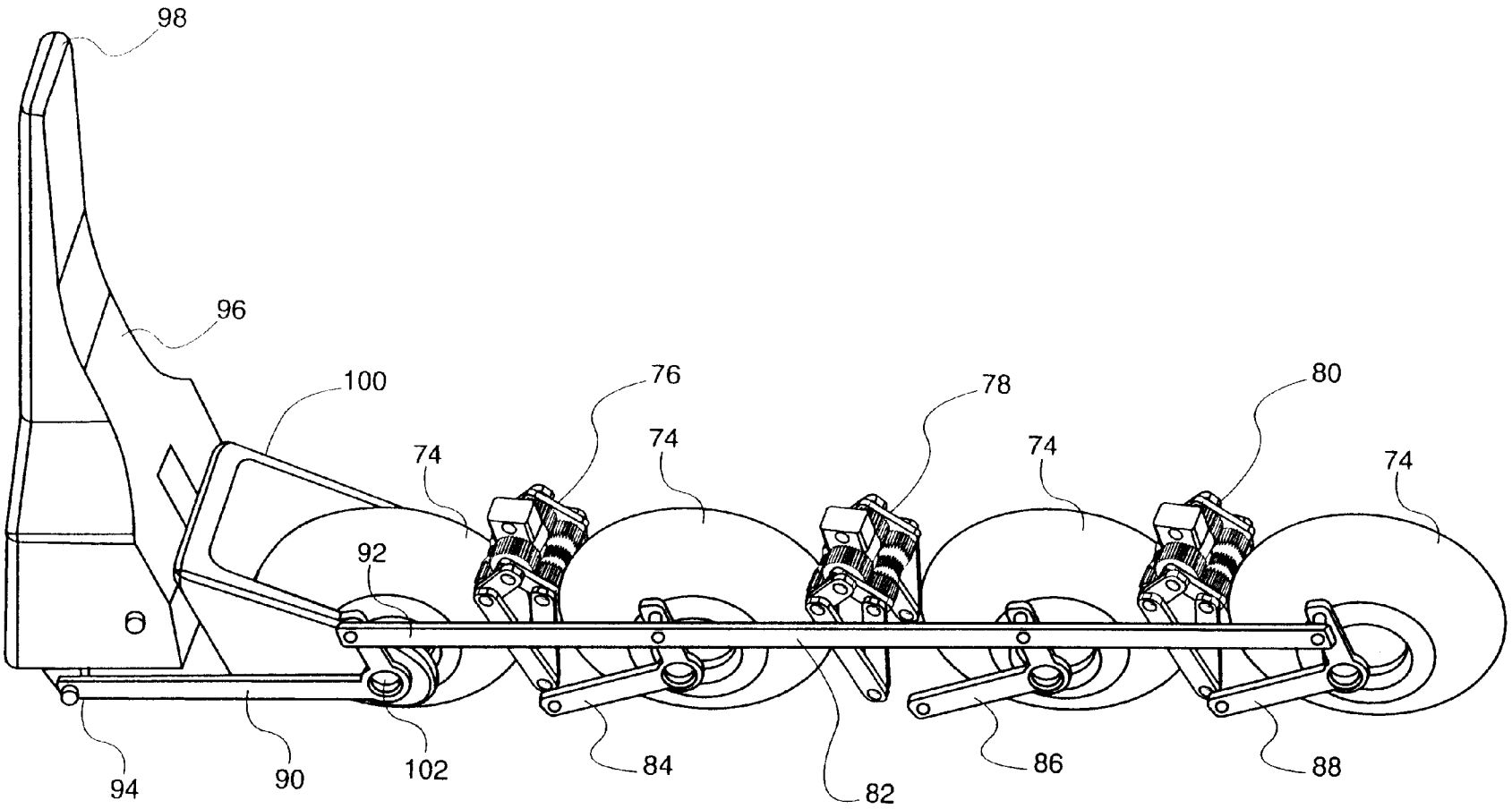
FIG. 11 illustrates the braking system of FIG. 10 with a skate frame being removed.

Referring to FIG. 10, an alternative embodiment of a braking system 70 will be described. Braking 70 includes a frame 72 which holds a plurality of in-line wheels 74 to a boot (not shown). As best shown in FIG. 11 (where frame 72 has been removed), braking system 70 further includes three braking units 76, 78 and 80. Braking system 70 may employ one or more of braking units 76, 78 and 80. Braking units 76, 78 and 80 are each pivotally connected to a central rail 82 by rocker arms 84, 86 and 88. For convenience of illustration, rocker arms 84, 86 and 88 are shown disconnected from central rail 82 and braking units 76, 78 and 80. However, it will be understood that appropriate pins will be provided to pivotally connect braking units 76, 78 and 80 to central rail 82 via rocker arms 84, 86 and 88. A back rocker arm 90 is pivotally attached to a rear end 92 of central rail 82 and translates central rail 82 in a generally back and forth motion when an end 94 of back rocker arm 90 is translated up and down.

To translate end 94 in a generally up and down motion, a female member 96 is provided. Female member 96 is connected to a cuff of the roller skate boot (not shown) at a proximal end 98 similar to the female member described in co-pending U.S. application Ser. No. 08/571,795, filed Dec. 13, 1995 (Attorney Docket No. 17251-000600), the complete disclosure of which is incorporated herein by reference. Female member 96 slides over a male member (not shown) which is attached to a carriage 100 which is non-movably attached to a rear axle 102 of rear wheel 74. In this manner, as the boot cuff is pivoted back and forth by the skater's leg, female member 96 is translated in a generally up and down motion to translate central rail 82 in a generally back and forth motion. Often, female member 96 may include a braking pad as described in co-pending U.S. application Ser. No. 08/571,795, previously incorporated by reference. It will be understood that other actuators may be employed to translate central rail 82 including a hydraulic system, a solenoid, and the like.

As female member 98 is translated downward, rocker arms 84, 86 and 88 pivot about the axles of wheels 74 to move braking units 76, 78 and 80 into contact with wheels 74.

Figure 12:
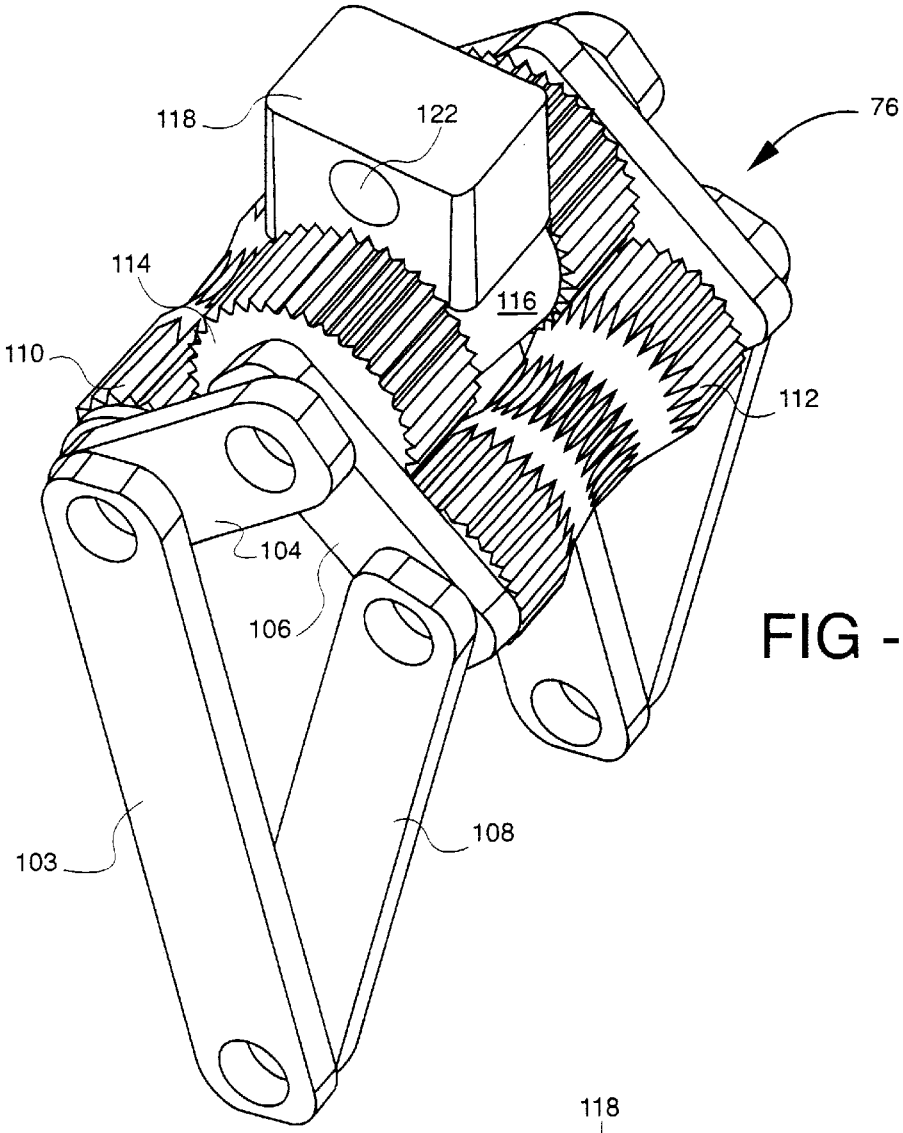
FIG. 12 is a perspective view of a braking unit of the braking system of FIG. 11.
Figure 13:
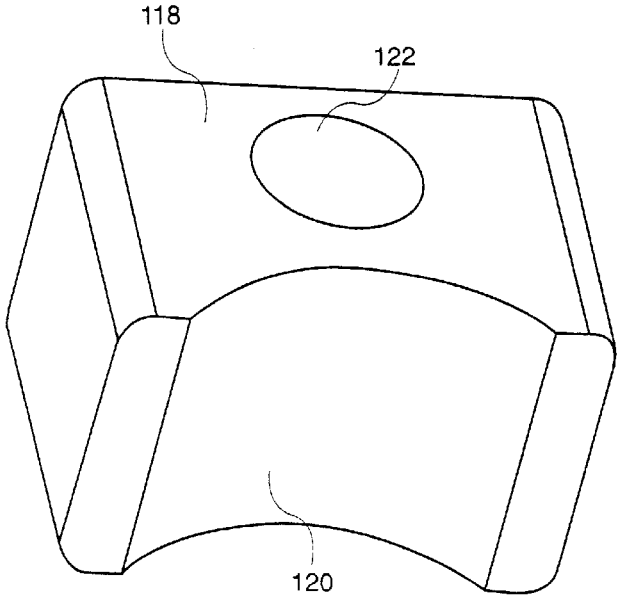
FIG. 13 is a perspective view of a braking pad of the braking unit of FIG. 12.

Referring now to FIG. 12, operation of braking units 76, 78 and 80 will be described. FIG. 12 illustrates braking unit 76, it being understood that braking units 78 and 80 are essentially identical to braking unit 76. Braking unit 76 includes four linkages 103, 104, 106 and 108 on each side. Linkages 103, 104, 106 and 108 are pivotally connected to each other by pivot pins (not shown). Braking unit 76 further includes two side gears 110 and 112 and a center gear 114. Side gears 110 and 112 come into contact with wheels 74 when braking unit 76 is lowered. Side gears 110 and 112 may optionally include ribs to prevent slippage of wheel 74 relative to side gears 110 and 112. Center gear 114 includes a central portion 116 which is spaced apart from the braking pad 118. Braking pad 118 is shown in FIG. 13 and includes a braking surface 120 which is designed to contact central portion 116 of gear 114. Braking pad 118 is preferably constructed of an elastomeric material such as rubber. Braking pad 118 is mounted to frame 72 (see FIG. 10) by a pin (not shown) extending through a lumen 122 of braking pad and into an aperture 124 of frame 72.

Referring back now to FIG. 11, operation of braking system 70 to slow or stop the skate will be described. When female member 96 is translated downward, rocker arms 84, 86 and 88 will pull on linkages 103 and 108 (see FIG. 12) until side gears 110 and 112 come into contact with adjacent wheels 74 (see FIG. 12). As side gears 110 and 112 contact wheels 74, they will begin to rotate. In turn, central gear 114 will also rotate. Since braking pad 118 is spaced apart from central portion 116, center gear 114 will freely rotate and will not cause a jerking reaction that may be felt by the skater. As female member 96 is translated further downward, linkages 103 and 108 are forced together to drive gear 114 toward braking pad 118. As central portion 116 engages braking pad 118, rotation of center gear 114 will gently begin to slow in turn causing side gears 110 and 112 to slow, thereby smoothly slowing the engaged wheels 74.

Side gears 110 and 112 and/or portions of center gear 114 will preferably be constructed of an insulated material such as a ceramic, so that heat generated between central portion 116 and braking pad 118 will not be transferred to wheels 74. In this manner, the heat generated in slowing or stopping wheels 74 will be kept away from the wheels. After wheel 74 has been slowed to the desired amount, female member 96 is translated upwards to disengage braking unit 76, 78 and 80 from wheels 74.

Figure 14A:
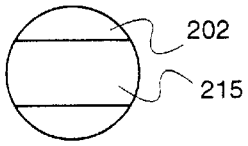
FIG. 14A illustrates an end view of a friction hub employed in an alternative braking system according to the invention.
Figure 14B:
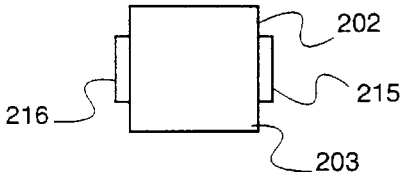
FIG. 14B illustrates a side view of the friction hub of FIG. 14A.
Figure 15A:
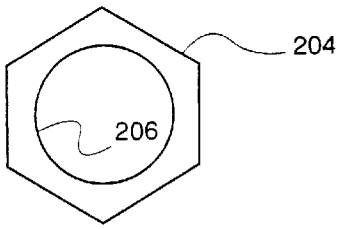
FIG. 15A illustrates an end view of an elastomeric friction pad.
Figure 15B:
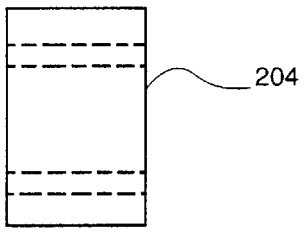
FIG. 15B illustrates a side view of the friction pad of FIG. 15A.
Figure 15C:
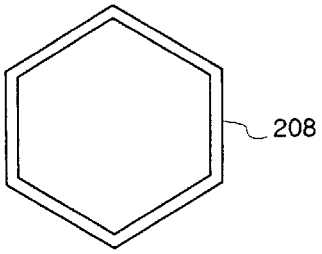
FIG. 15C illustrates an end view of an insulating member.
Figure 15D:
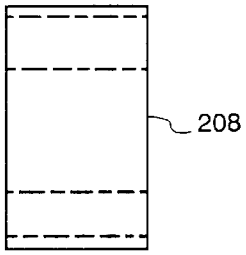
FIG. 15D illustrates a side view of the insulating member of FIG. 15C.
Figure 16A:
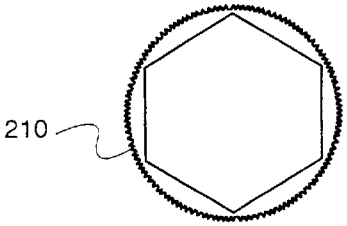
FIG. 16A illustrates an end view of a wheel engaging hub.
Figure 16B:
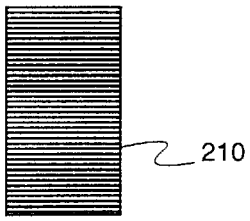
FIG. 16B illustrates a side view of the engaging hub of FIG. 16A.
Figure 17A:
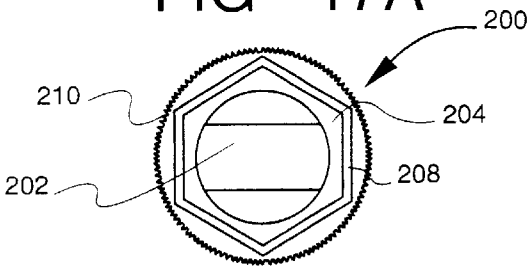
FIGS. 17A and 17B illustrates the assembly of the friction hub, friction pad, insulating member and engaging hub of FIGS. 14A, 15A, 15C and 16A to form a brake unit employed in an alternative braking system according to the invention.
Figure 17B:
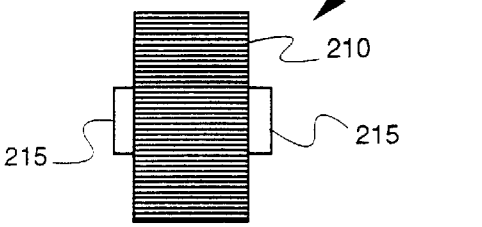

FIGS. 17A and 17B illustrate an alternative embodiment of a braking unit 200 according to the invention. The components of braking unit 200 are illustrated in FIGS. 14–16, it being appreciated that the drawings are not necessarily shown to scale. As illustrated in FIGS. 14A and 14B braking unit 200 includes a friction hub 202 that is preferably constructed of aluminum (which is a good conductor of heat), although other durable materials could be used. Friction hub 202 preferably includes a roughened surface, such as by knurling or by providing serrations. The friction hub 202 is inserted into a friction pad 204 (see FIGS. 15A and 15B) having an inner surface or bore 206. Friction hub 204 is preferably constructed from an elastomeric material, rubber, cork, asbestos, and the like. Various combinations of materials may also be used to create friction surfaces, including, cork and rubber, metal on metal, soft steel on phosphor bronze, and the like. The interface between the friction hub and the friction pad should produce sufficient friction for stopping while also providing exemplary wear characteristics. The friction pad may optionally be inserted into an insulator 208 (see FIGS. 15C and 15D) which is then inserted into an outer wheel engaging hub 210 or drive roller (see FIGS. 16A and 16B). Hub 210 will preferably have a roughened surface, such as by including serrations or by knurling the surface, to prevent slippage of hub 210 when it engages the wheels.

Figure 18:
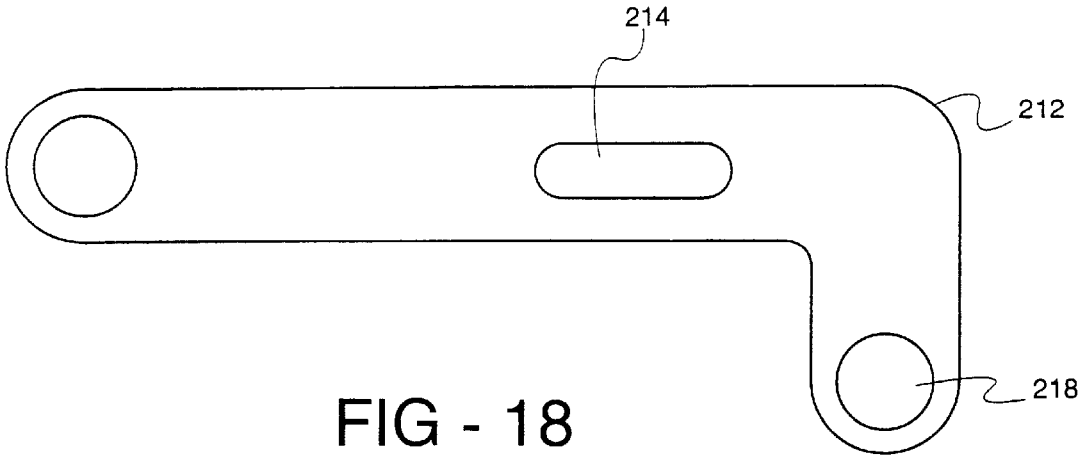
FIG. 18 illustrates a side view of a brake arm according to the invention.
Figure 19:
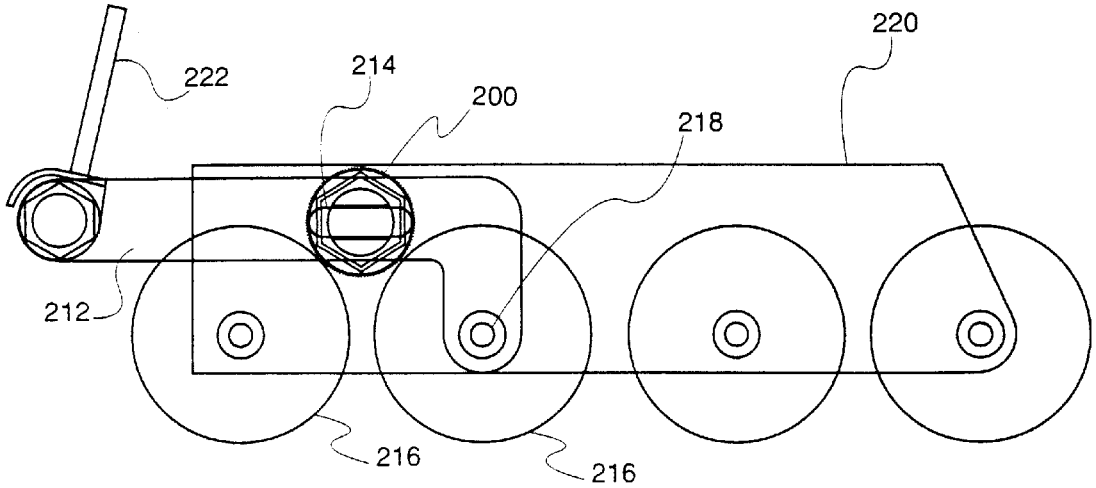
FIG. 19 illustrates one embodiment of a braking system employing the brake arm of FIG. 18 and the brake unit of FIG. 17.

FIG. 19 illustrates brake unit 200 attached to a brake arm 212 (see FIG. 18) having a slot 214 for receiving protrusions 215 on friction hub 202 (See FIGS. 14A and 14B). It will be appreciated that, for the embodiment of FIG. 19 as well as the other plan view embodiments shown hereinafter, a corresponding brake arm is included on the opposite side of the skate. For convenience of illustration, frame 220 and brake arm 212 are shown to be transparent. Protrusions 215 are slidable within slot 214 to allow brake unit to properly adjust its orientation when engaging wheels 216 of a skate as illustrated in FIG. 19. Brake arm 212 is pivotally mounted at a pivot point 218 to a frame 220 of the skate. When arm 212 is pivoted downward, brake unit 200 centers between wheels 216 by virtue of sliding action of protrusions 215 of friction hub 202 in slots 214 of arm 212, and wheel engaging hub 210 is engaged between a pair of wheels 216. In turn, wheel engaging hub 210 is compelled to rotate by the turning wheels of the skate, similar to the engagement of gears one with another.

As the wheel engaging hub 210 rotates, the friction pad 204 is rotated at the same rate by virtue of its engagement within the wheel engagement hub (facilitated by the hexagonal geometry). Braking results when the inner surface 206 of the friction pad 204 rotates around the friction hub 202. In turn, the friction hub 202 (which is constrained not to rotate by engagement of protrusions 215 within slot 214) provides a friction surface for the friction pad 204. The surface texture of the friction pad 204, combined with the compound type and hardness of the friction pad 204, serves to slow rotation of wheel engaging hub 210 which in turn resists the turning motion of the skate wheels 216. In this way, wheel engaging hub 210 serves to slow the skate to which the wheels are attached with minimal or no slippage of wheel engaging hub 210. Conveniently, the insulator 208 serves to prevent the generated heat from transferring to the outer hub 210 to protect the wheels.

One advantage of such a system is that essentially no jerking action is produced when the brake is engaged. Since the amount of braking is generally proportional to the force being applied to actuate the braking system, a smooth slowing action is produced when the brake is applied.

It will be appreciated that a variety of mechanisms may be employed to engage the friction hub with the friction material rotating around the friction hub. For example, such mechanisms may include, centrifugal engagement, magnetic engagement, slip couplings, wrapped spring clutches, band clutches, and other mechanisms which allow the friction hub to be engaged with the outer hub to facilitate controlled, adjustable slippage between the two hubs.

One particular advantage of brake unit 200 is that it remains spaced-apart from the wheels when not in use. In this way, brake unit 200 does not slow the turning wheels (by providing a frictional force on the wheels) until actuated by the skater. Hence, the braking system is able to rapidly slow or stop a skater without hindering the gliding ability of the skate. Further, since brake unit 200 is held within frame 220, brake unit 200 will not interfere with movement of the skates, such as when performing crossovers where one skate is moved in front of the other.

As illustrated in FIG. 19, the brake arm 212 is actuated by a rod 222 or other rigid member which extends to a cuff of a skate. Alternatively, an elongated member or paddle as shown in FIG. 33 of U.S. patent application Ser. No. 08/664,068, previously incorporated by reference (and as illustrated in FIG. 22C herein), may be employed to activate either a rod, a lever, a cable or the like to move brake unit 200 into wheel engagement. As another alternative, one or more bladders (back, front, or sides of the skate leg) containing air or liquid may be used to move the brake arm.

As illustrated in FIGS. 20, 20A and 20B, the brake arm of FIG. 18 may be modified to includes a pair of brake units 200. As shown in FIG. 20A, a brake arm 224 includes a wheel pivot point 226 and a linkage pivot point 228. A linkage 230 (see FIG. 20B) is pivotally attached to pivot point 228 and has a pair of slots 232 and 234 for receiving brake units 200 as shown in FIG. 20. In this way, as brake arm 224 is pivoted downward, brake units 200 engage wheels 216 to slow or stop the skate in a manner similar to that previously described in connection with FIG. 19. It will be appreciated that brake units 200 can be mechanically constrained to apply numerically equivalent amounts of pressure, and hence equal amounts of braking resistance to wheels 216. For convenience of illustration, frame 220, brake arm 224 and linkage 230 are shown to be transparent.

Braking with brake units 200 is generally a two step process which allows for controlled slowing of the skate, i.e. without creating a jerking action or locking up of the wheels. In the first step, wheel engaging hub 210 initially comes into contact with the rotating wheels. The roughed surface of hub 210 allows hub 210 to begin rotating. Further, a sufficient gap is provided between inner surface 206 and friction hub 202 so that wheel engaging hub 210 may easily rotate when coming into contact with the rotating wheel.

As part of the first step, slots 232 and 234 allow braking units 200 to position themselves between a pair of wheels. In this way, braking units 200 will be in contact with and rotating between two wheels in a smooth manner before braking begins.

In step two, braking begins by increasing the force at which wheel engaging hub 210 is pressed against the rotating wheels. At this point inner surface 206 is forced into contact with friction hub 202 to begin braking. In this way, essentially all of the braking units will be positioned correctly between their associated wheels before braking begins so that braking will occur in a controlled and smooth manner.

As illustrated in FIGS. 21–21C, a brake arm 236 may be provided for receiving three brake units 200. As shown in FIG. 21A, brake arm 236 includes a wheel pivot point 238 and a linkage pivot point 240. A linkage 242 (see FIG. 21B) is pivotally attached to pivot point 240 and has a slot 244 for receiving one of the brake units 200. A second linkage 245 (see FIG. 21C) is pivotally attached to the first linkage 242 at a pivot point 246. Second linkage 245 includes a pair of slots 248 and 250 for receiving brake units 200 as shown in FIG. 21. In this way, as brake arm 236 is pivoted downward, brake units 200 engages all four wheels 216 to slow or stop the skate in a manner similar to that previously described in connection with FIGS. 19 and 20. For convenience of illustration, frame 220, brake arm 236, linkage 242 and linkage 245 are shown to be transparent.

Alternatively, as illustrated in FIG. 22, a pair of lever arm members 252 and 254, welded to form an integral unit, may be used in combination to move brake unit 200 into contact with a pair of wheels 216. Arm 252 (see FIG. 22A) will preferably be longer than arm 254 (see FIG. 22B) and will preferably be attached to an axle 256 and positioned exterior to frame 220 of the skate. Arm 254 is also attached to axle 256 and is positioned in the interior of skate frame 220. Arms 252 and 254 are attached together at their distal ends so that when rod 222 is lowered, a slot 258 in arm 254 having brake unit 200 will be lowered to move brake unit 200 into engagement with wheels 216. For convenience of illustration, frame 220 and arm members 252, 254 are shown to be transparent.

As illustrated in FIG. 22C, brake units 200 may be placed into wheel engagement by employing a paddle 340 which is placed in the interior of the shoe or boot of the skate similar to the embodiments described in copending application Ser. No. 08/664,068, previously incorporated by reference. Paddle 340 is pivotally attached to the frame 220 and includes a pin 342 which slides in an aperture 344 of a brake arm 346 (which may be constructed similar to the brake arms previously described herein). When a skater pushes back on paddle 340, pin 342 pushes brake arm 346 in a generally downward direction so that it will pivot about front axle 238 to move braking units 200 into wheel engagement similar to the embodiments previously described. When the pressure is released from paddle 340, a spring or other biasing member (not shown) will push paddle 340 forward to cease the braking action.

Referring now to FIG. 23, an alternative embodiment of a braking system 260 will be described. Braking system 260 operates in a manner similar to the brake system illustrated in FIG. 19, except that braking system 260 is actuated by an eccentric pivot via a cable, lever, rod or the like. As best shown in FIGS. 23 and 24, brake system 260 comprises a plurality of brake units 262 which are pivotally attached to the frame of the skate (not shown). Brake units 262 are similar to brake units 200 as previously described and comprise an outer wheel engaging hub 264 (or drive roller), a friction pad 266 held within wheel engaging hub 264 and a friction hub 268 disposed within friction pad 266. Friction hub 268 includes an eccentric pivot point 270 which allows friction hub 268 to be pivotally mounted to the skate frame.

As also shown in FIGS. 36 and 37, friction hub 268 includes a cable slot 272 for receiving a cable 274 (see FIG. 24). A set screw (not shown) is inserted into a threaded hole 276 to secure cable 274 to friction hub 268. In this way, when tension is applied to cable 274, brake units 262 pivot about point 270 causing wheel engaging hub 264 to move into engagement with wheels 278 of the skate in a smooth manner. In turn, wheel engaging hub 264 and friction pad 266 are caused to rotate by the rotating wheels similar to brake unit 200 as previously described, without causing a jerking action on the skate. Since friction hub 268 is prevented from rotating by virtue of its pivotal attachment through aperture 270 to the skate frame, a frictional force will be created between friction pad 266 and friction hub 268. In turn, the rotation rate of wheel engaging hub 264 will be slowed, thereby causing wheels 278 to slow or stop. As shown in FIGS. 38 and 39, friction hub 268 may be provided with a torsion spring 280 which is attached to the skate frame. Torsion spring 280 moves brake unit 260 out of wheel engagement after the tension in cable 274 is released.

As shown in FIGS. 23, 26 and 32, an actuating mechanism 282 is employed to tension cable 274 and a cable 284 in order to move the three brake units 262 into wheel engagement. Mechanism 282 comprises a rod 288 having a first end 290 and a second end 292. Second end 292 is attached to a base member 298 which in turn is attached to a cylindrical member 300. Cylindrical member 300 is pivotally engaged with a linkage 294 which is turn is pivotally attached to an axle 296 of wheel 278. First end 290 is operably attached to a mechanism (not shown) for moving rod 288 to cause link 294 to rotate about axle 296. A variety of mechanisms as previously described herein may be employed to move rod 288, including a cuff of the skate (such as is shown in FIG. 1) or a paddle as described in copending application Ser. No. 08/664,068, previously incorporated by reference.

Figure 29:
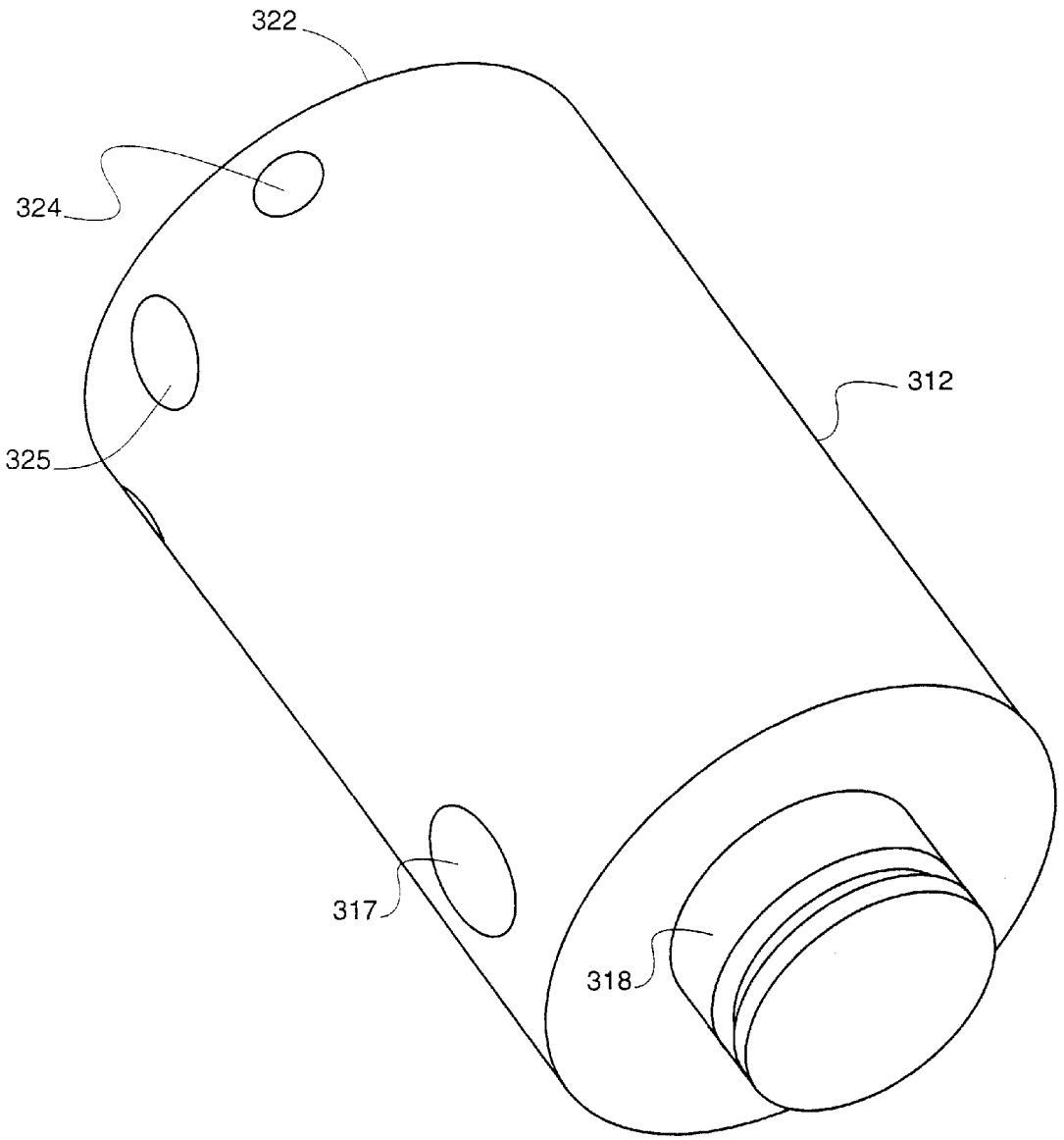
FIGS. 29 and 30 are perspective views of a pivot member employed in the braking system of FIG. 23.
Figure 30:
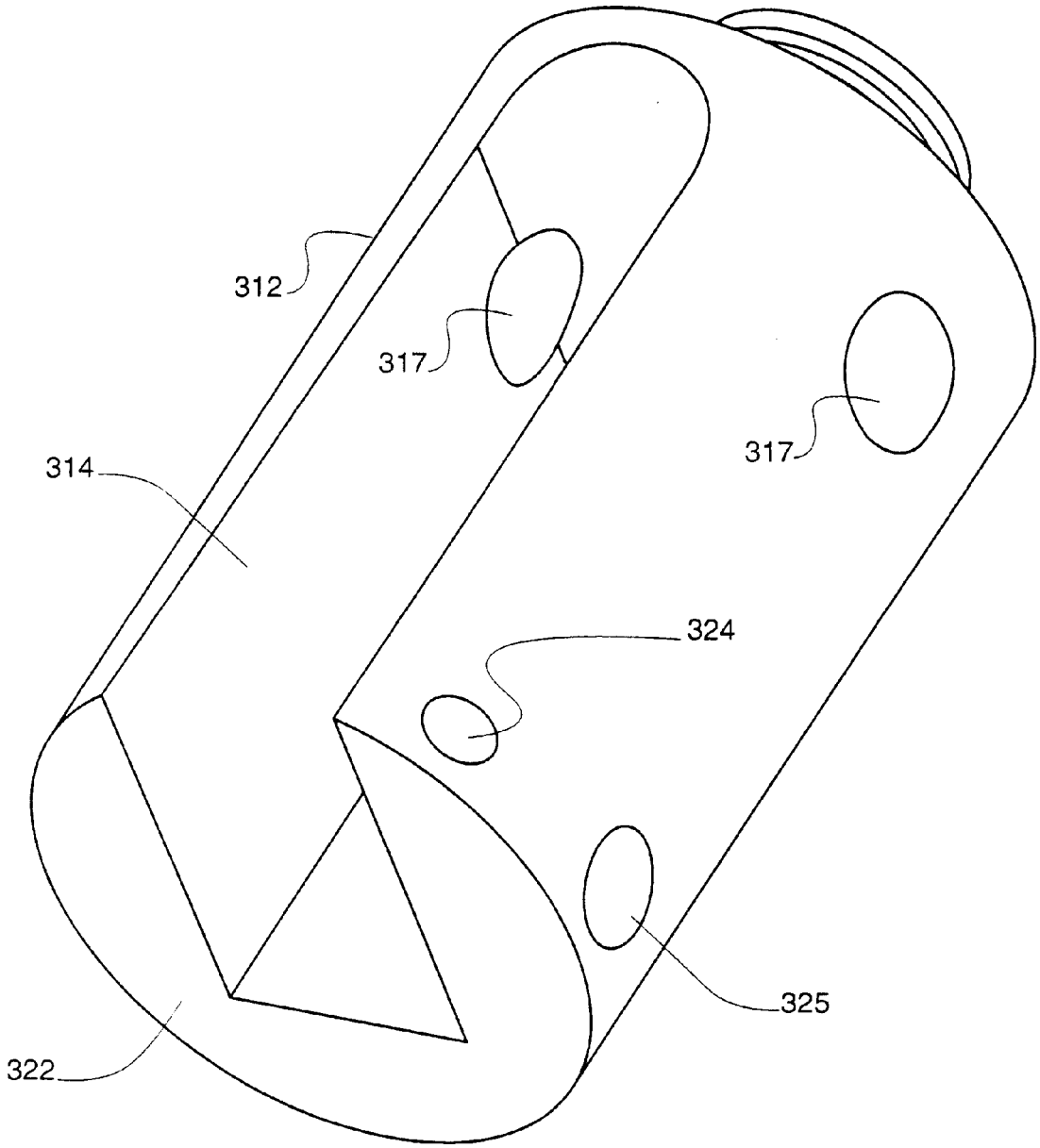

As best shown in FIG. 32, base member 298 includes a pair of slots 301. A hole 302 is provided in base member 298 and extends between slots 301. A link member 306 (see also FIGS. 33 and 34) is received into slots 301 and is pivotally attached to base member 298 by placing a pin 308 (see FIG. 23) through a lumen 310 in link member 306 and through hole 302. Link member 306 is also attached to a pivot member 312 (see FIGS. 29–31 and 35). As best shown in FIG. 35, link member 306 is slid into a slot 314 (see FIG. 30) of pivot member 312 and a pin 316 is inserted through holes 317 (see FIGS. 29 and 30) to hold link 306 to pivot member 312.

Figure 25:
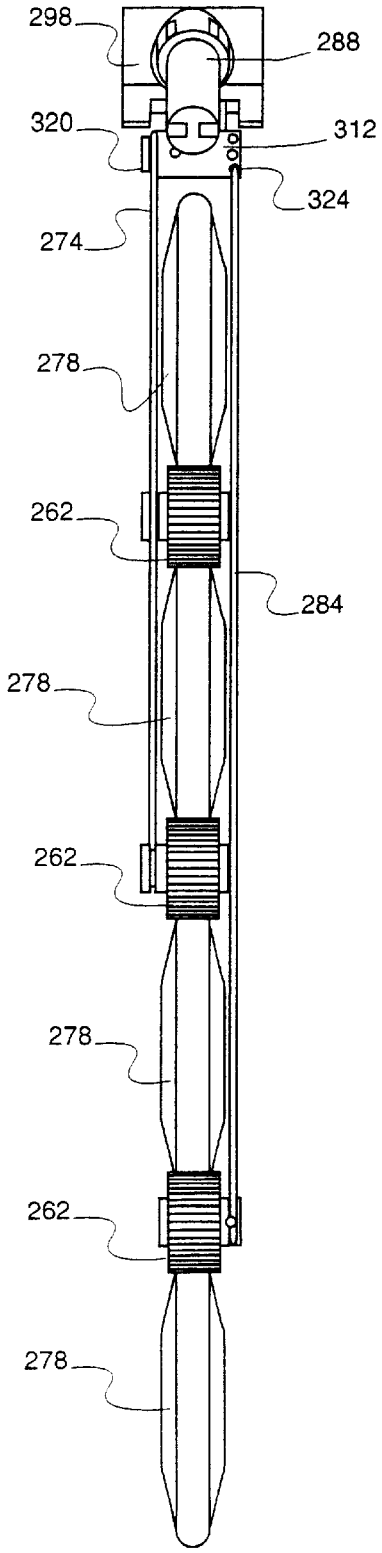
FIG. 25 is a top view of the brake system of FIG. 23.
Figure 26A:
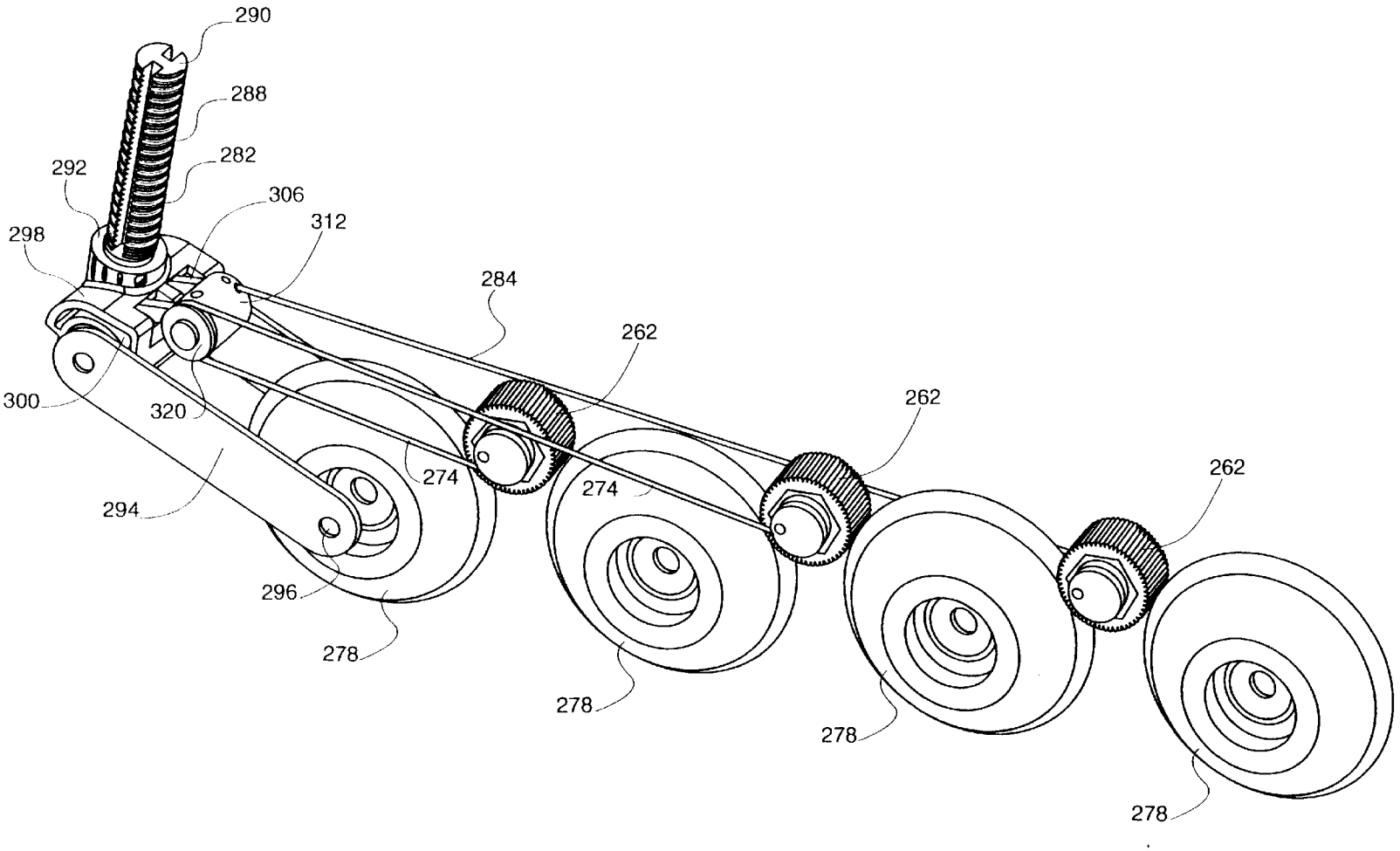
FIGS. 26A and 26B are perspective views of the brake system of FIG. 25.
Figure 26B:
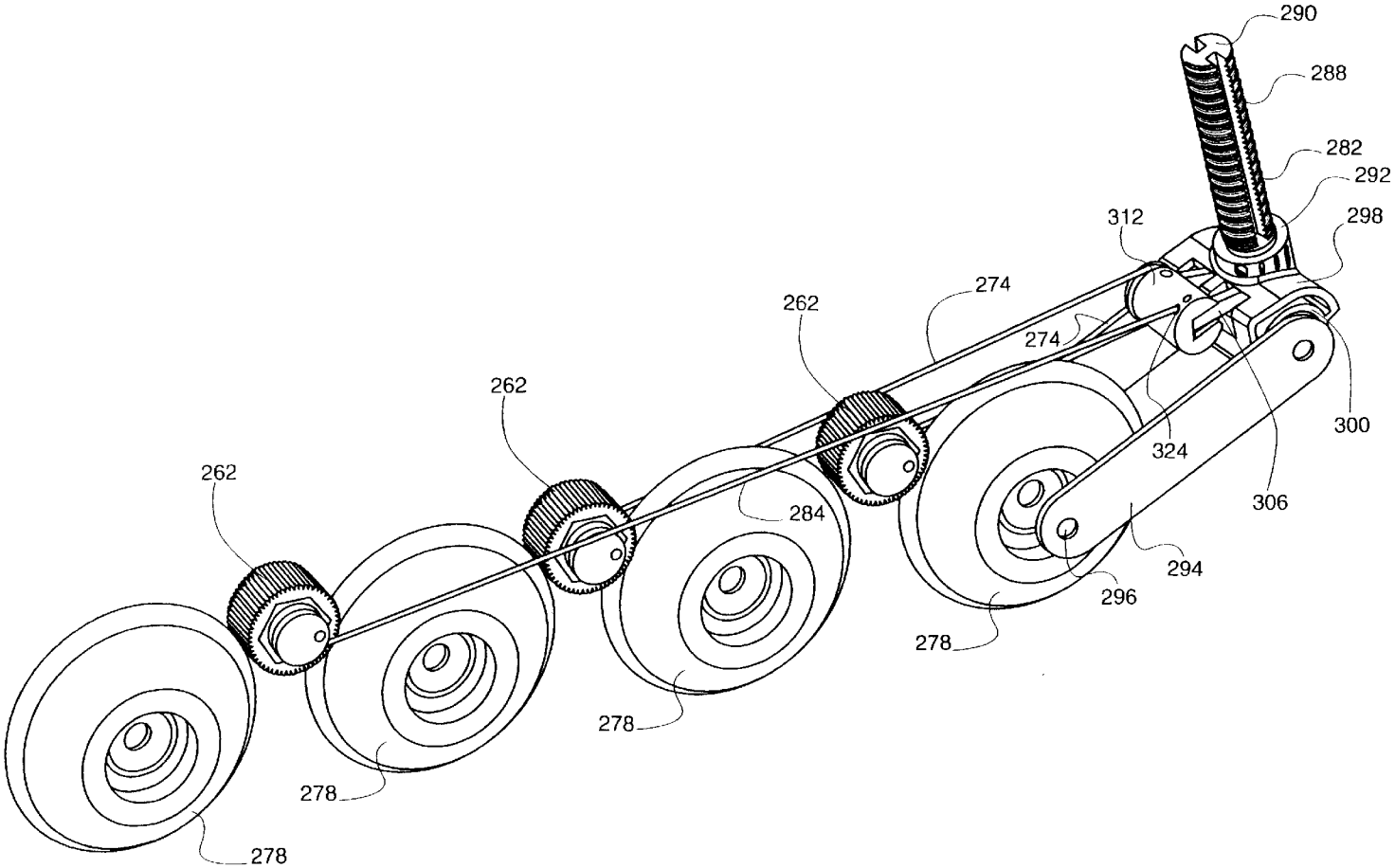

Rotatably received about an end 318 of pivot member 312 is a spool 320 (see FIGS. 26A, 27, 28 and 28A). Spool 320 includes a groove 322 for receiving cable 274. As best shown in FIGS. 23 and 26A spool 320 allows cable 274 to be attached to two braking units 262. An opposite end 322 of pivot member 312 includes a set screw 324 into which an end of cable 284 is received (see FIG. 25). A hole 325 is provided to receive a set screw (not shown) to hold cable 284 in place. Hence, as best illustrated in FIGS. 26A and 26B, when rod 288 is moved in a generally downward direction, link 294 pivots about axle 296. In turn, link member 306 and pivot member 312 are moved generally to the left. This causes tension in cables 274 and 284 which in turn moves each of the three brake units 262 into wheel engagement. It will be appreciated that cables 274 and 284 can be mechanically constrained to apply numerically equal amounts of pressure, and hence equal amounts of braking resistance to wheels 278. Once sufficient braking has occurred, the force on rod 288 is subsided to remove the tension in cables 274 and 284. Torsion spring 280 (see FIG. 38) then moves braking units 262 out of wheel engagement.

Cooling of the braking systems described herein may take place in a number of ways, including convection, conduction and radiation. One method of cooling is a closed system illustrated in FIG. 40 where liquid is drawn by means of a pump 300 that is driven by the rotation of the braking unit during braking. The fluid passes through a remotely located heat exchanger 302 after flowing through passages in a friction hub 304 of the braking unit.

Figure 40:
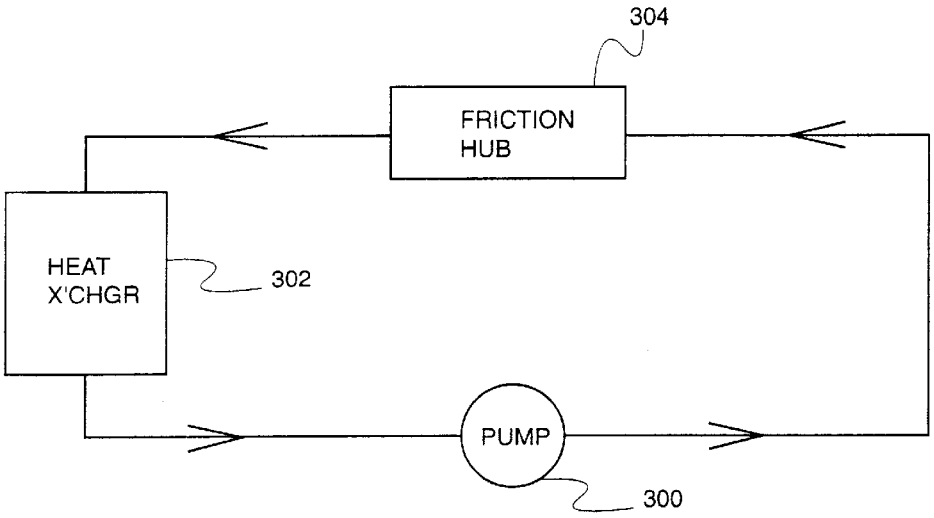
FIG. 40 is a schematic diagram of an alternative embodiment of a braking system according to the invention.
Figure 41:
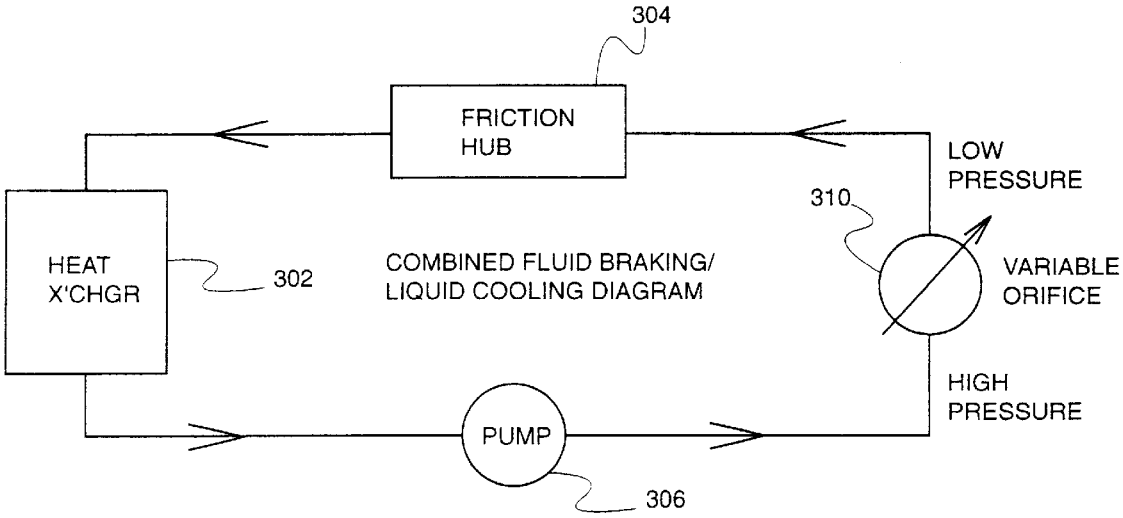
FIG. 41 is a schematic view of yet another alternative embodiment of a braking system according to the invention.

FIG. 41 illustrates another alternative cooling system which is similar to the system set forth in FIG. 40, except that the fluid is used in a torque converter pump 306 or similar device. In this way, the fluid is used to dissipate energy. By regulating the size of an orifice 310 in the circuit, the amount of resistance can be varied by the brake actuator. Cooling of the fluid, if required, is accomplished as previously described in connection with FIG. 40.

Pump 306 will preferably comprise a positive displacement fluid pump, such as a gear pump or piston pump. The working fluid will preferably comprise oil since it may also be used to lubricate the system. Because the oil is generally incompressible and a positive displacement pump is driving the system, the variable orifice may be used to vary the flow through the system, thereby increasing or decreasing the resistive or braking torque seen by the pump. Because the wheels of the skate are driving the pump during the application of the brake system, the wheels will in turn see a resistive torque as governed by the size of the variable orifice.

As a result of the work done by the system during braking, the oil temperature will rise. The heat energy in the oil is removed to the atmosphere as the oil passes through an appropriately sized heat exchanger that is preferably positioned outboard of the skate where optimum air flow may occur.

To activate the brake, the pump drive roller will preferably be applied to the wheel with little or no resistance to rotation, such that the skater will not experience any sudden jerking, but will be applied with sufficient force to transmit the torque loads required as the variable orifice is reduced in size as described below.

The pump drive roller is maintained against the wheels as the variable orifice is modulated in response to input from the skater. As resistance to flow increases in the system, actual braking occurs. The skater is able to modulate the size of the orifice as required to achieve the desired braking resistance at any time.

Figure 42:
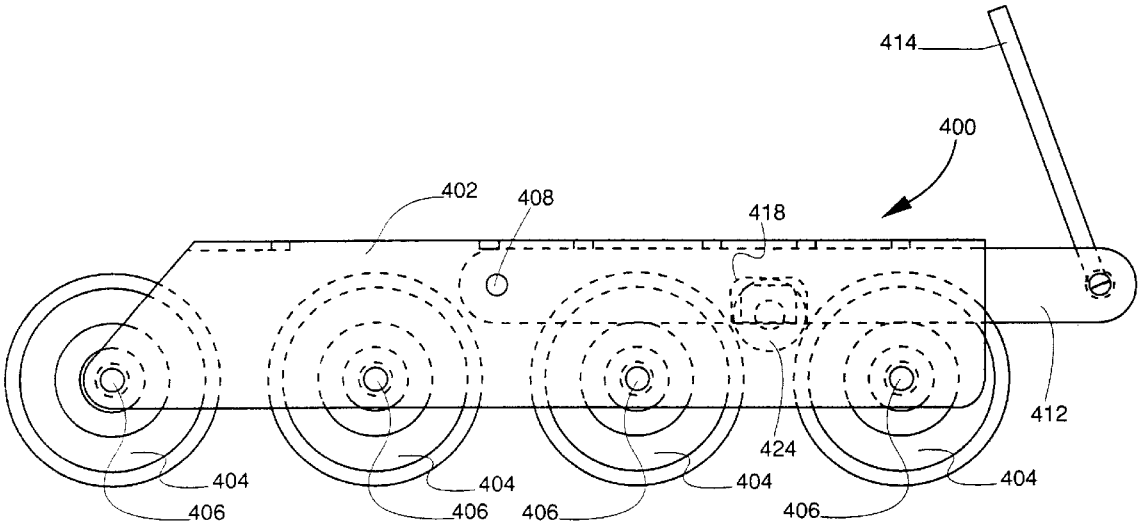
FIG. 42 is a side view of another alternative braking system according to the invention.
Figure 43:
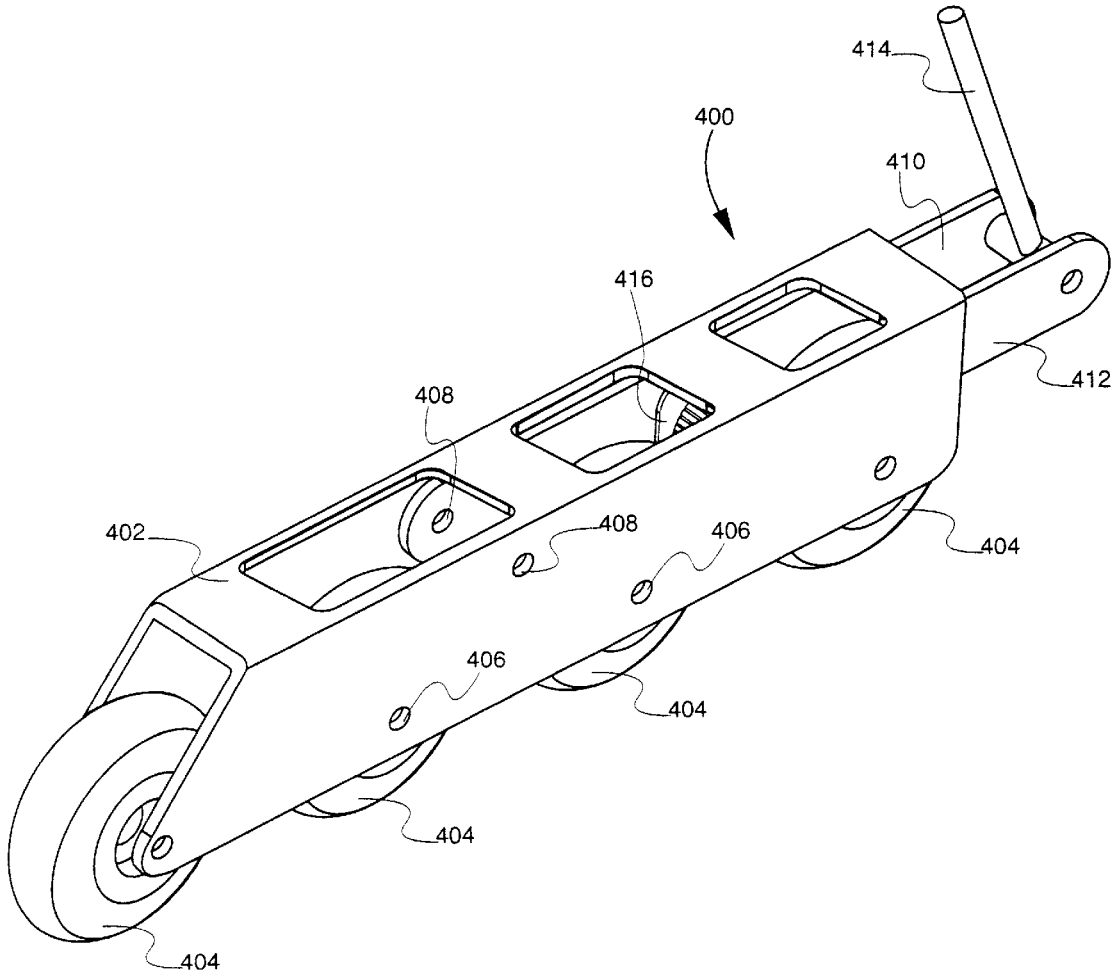
FIG. 43 is a top perspective view of the braking system of FIG. 42.
Figure 44:
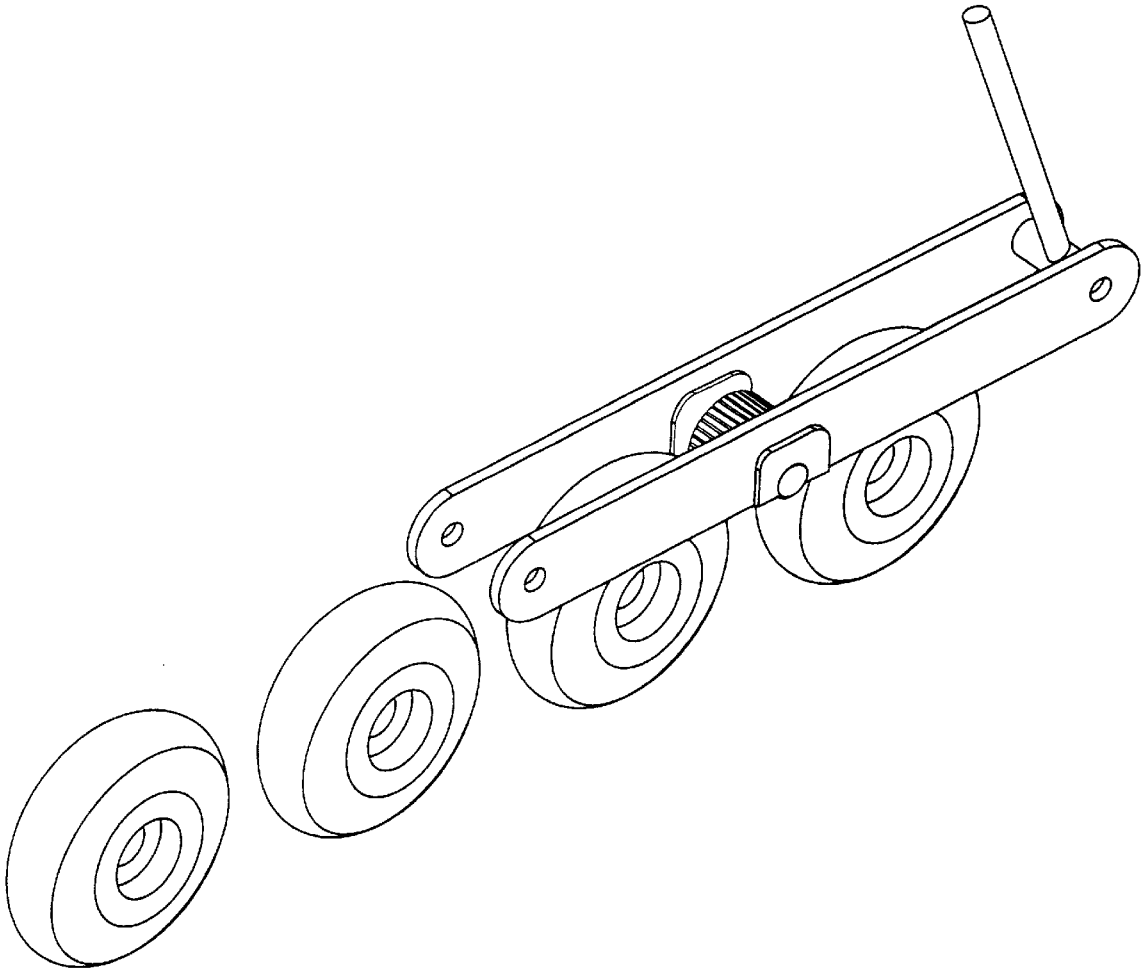
FIG. 44 illustrates the braking system of FIG. 43 with a frame of the skate being removed.

Referring now to FIGS. 42 and 43, an alternative embodiment of a braking system 400 will be described. Braking system 400 is preferably coupled to a skate frame 402. A plurality of wheels 404 are coupled to skate frame 402 by axles 406. As is known in the art, frame 402 is coupled to a shoe or boot (which is not shown for convenience of illustration).

Pivotally coupled to frame 402 at pivot points 408 are brake arms 410 and 412. Pivotally coupled between arms 410 and 412 is a rod 414. Rod 414 is employed to pivot arms 410 and 412 about pivot points 408. Conveniently, rod 414 may be coupled to a cuff of the skate so that arms 410 and 412 may be pivoted by moving the cuff as described with previous embodiments. Alternatively, it will appreciated that other mechanisms may be employed to pivot arms 410 and 412 as described with previous embodiments.

Figure 45:
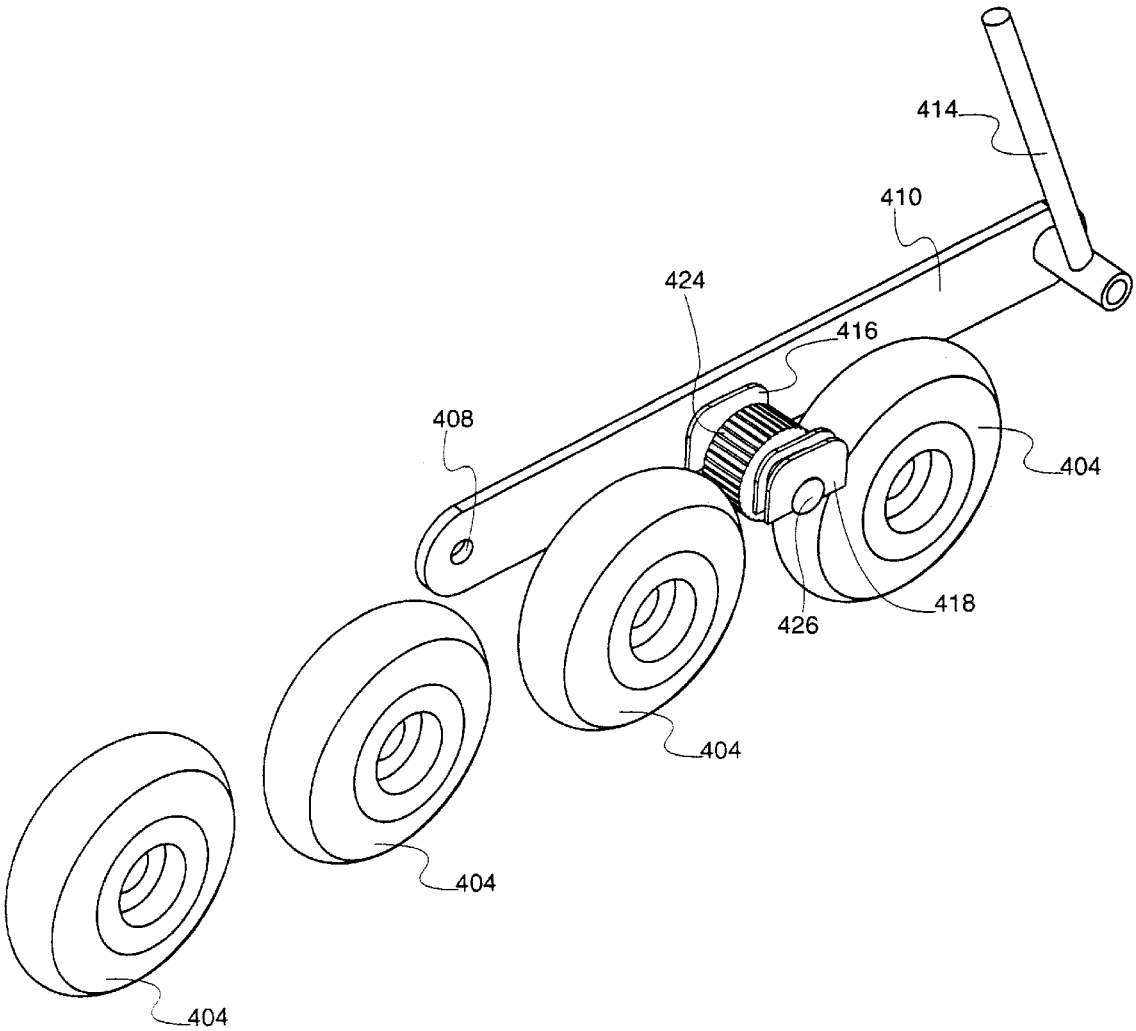
FIG. 45 illustrates the braking system of FIG. 44 with one of the brake arms being removed.
Figure 46:
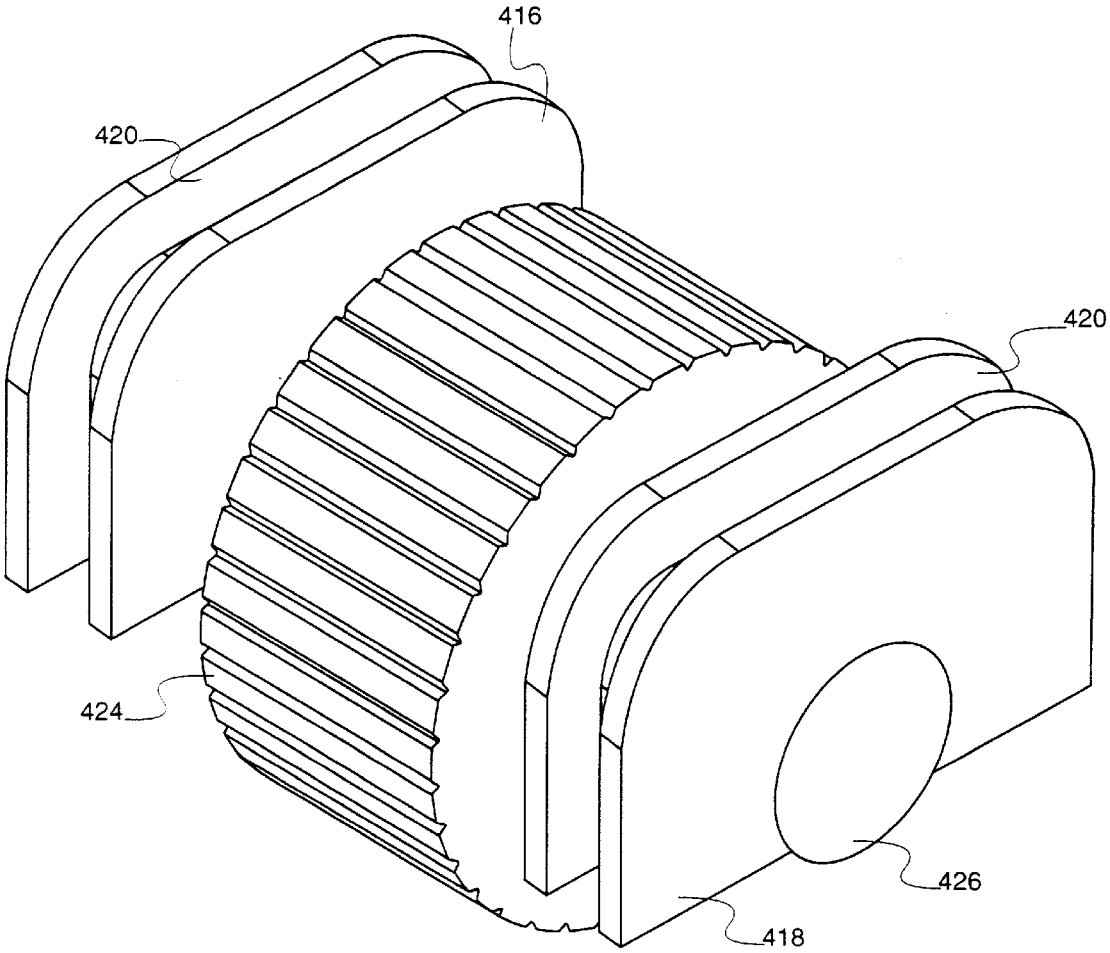
FIG. 46 illustrates a rotatable member and a pair of liners of the braking system of FIG. 45.
Figure 47:
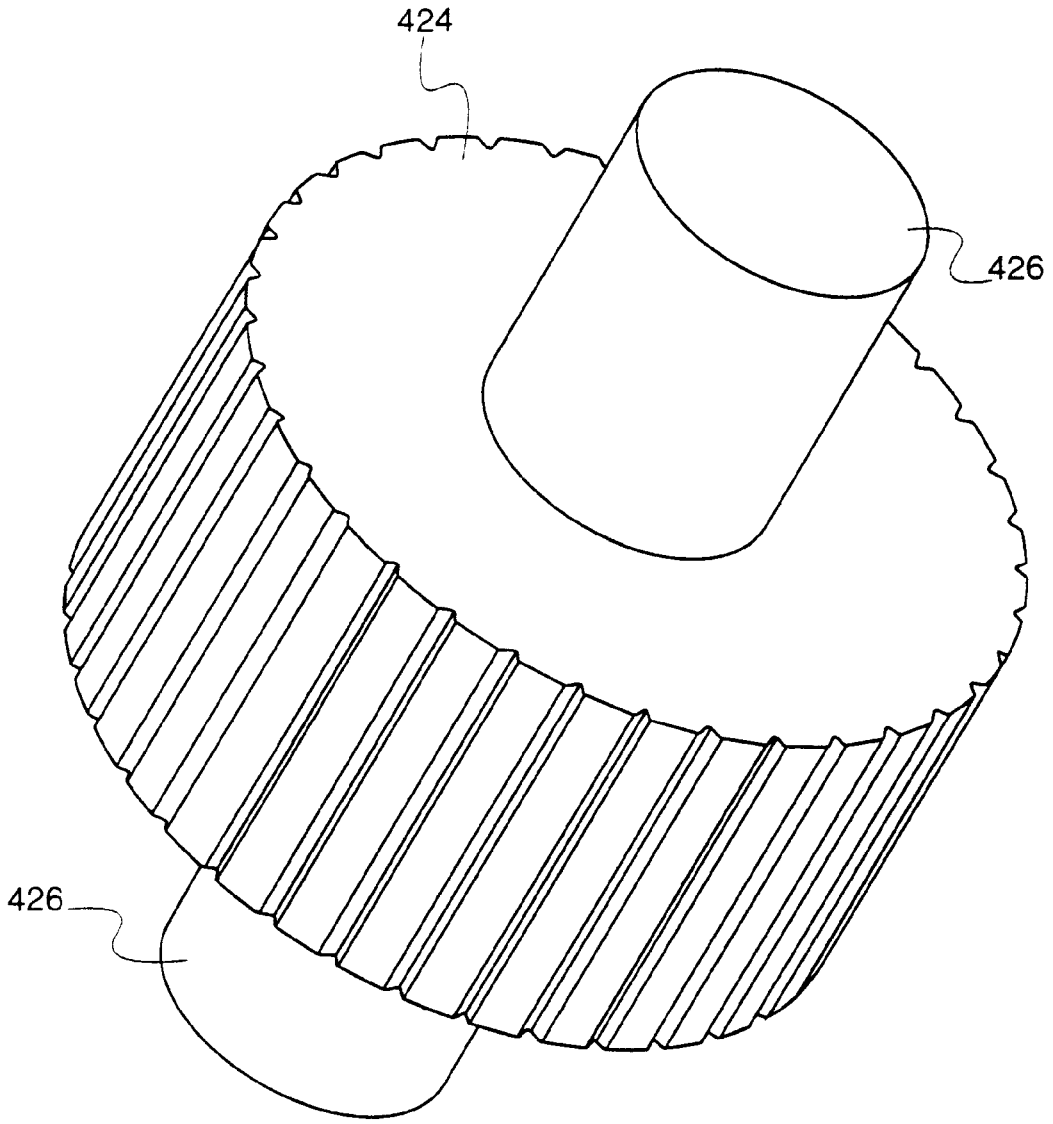
FIG. 47 illustrates the rotatable member of FIG. 46.
Figure 48:
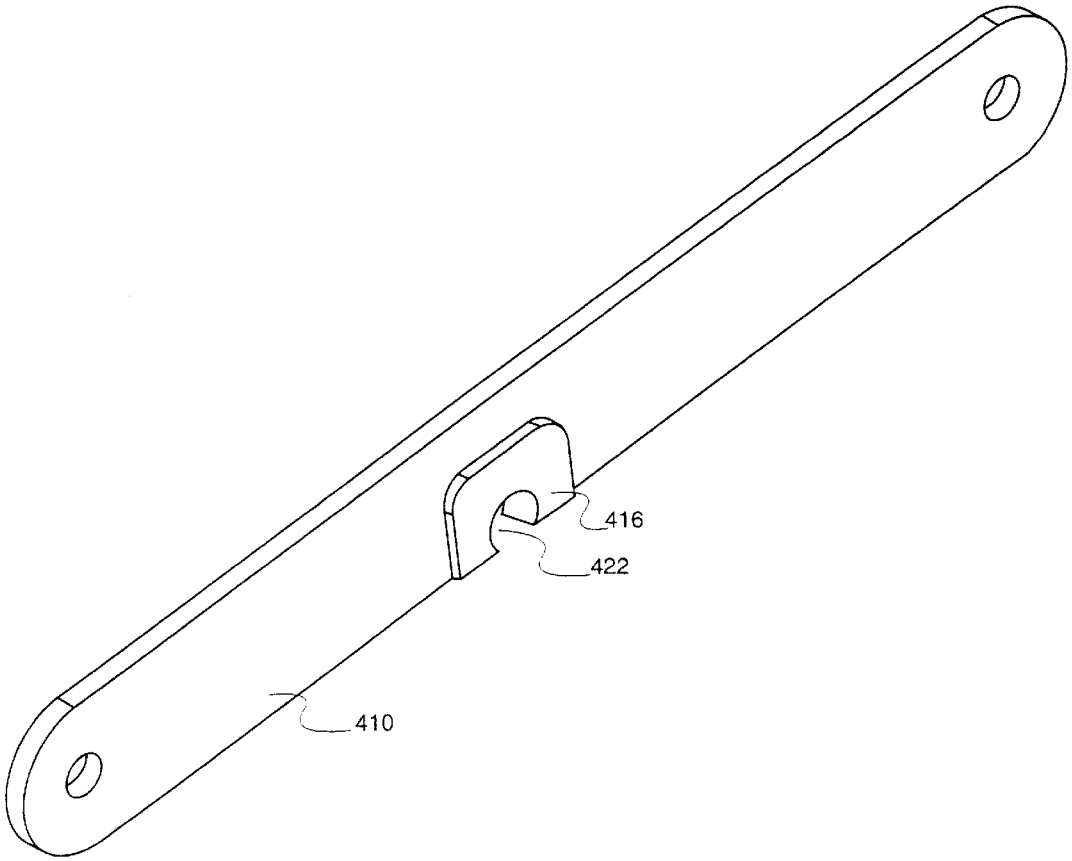
FIG. 48 illustrates a brake arm and a liner of the braking system of FIG. 45.

Referring also now to FIGS. 45, 46 and 48, a pair of liners 416 and 418 are removably attached to brake arms 410 and 412, respectively. As best shown in FIG. 46, liners 416 and 418 each include a slot 420 which allows liners 416 and 418 to be inserted into openings in brake arms 410 and 412. Such an arrangement is particularly preferable since it allows for the convenient removal of liners 416 and 418 when the liners need to be replaced. As such, the liners may be replaced simply by pulling them from brake arms 410 and 412 and inserting new liners. As best shown in FIG. 48, each of liners 416 and 418 includes an opening 422 which allow a rotatable wheel engaging member 424 to be coupled between liners 416 and 418 as shown in FIG. 46. As best shown in FIG. 47, wheel engaging member 424 includes an axle 426 which is received into openings 422 (see FIGS. 46 and 48). In this way, rotatable member 424 is rotatably coupled to arms 410 and 412.

With such a configuration, when arms 410 and 412 are pivoted downward, rotatable member 424 engages one or more of wheels 404 to cause rotatable member 424 to rotate. Conveniently, the surface of rotatable member 424 may be serrated or grooved as shown to facilitate rotation of rotatable member 424 when engaging one or more of wheels 404. Although not shown, it will be appreciated that more than one rotatable member and corresponding liners may be coupled along arms 410 and 412 in a manner similar to that described with previous embodiments.

When rotatable member 424 begins to rotate, friction is created between the liners 416 and 418 and axle 426 which serves to slow rotation of rotatable member 424. In turn, one or more of wheels 404 is slowed. Due to the grooves in rotatable member 424, essentially no slippage occurs between wheels 404 and rotatable member 424 so that the wheels are slowed in a smooth and efficient manner.

Liners 416 and 418 are preferably constructed of materials similar to those previously described with other brake pads. Rotatable member 424 and axles 426 may be constructed of essentially any rigid material including composites, metals, aluminum, and the like. Optionally, insulation may be provided between axle 426 and the outer surface of rotatable member 424 so that heat generated between axle 426 and liners 416 and 418 is substantially prevented from reaching the outer surface of rotatable member 424. In this way, essentially no heat created during braking will be transferred to wheels 404.

Rotatable member 424 is preferably maintained spaced apart from wheels 404 until ready to begin braking. To initiate braking, rod 414 is pushed to lower arms 410 and 412. In turn, rotatable member 424 is brought into contact with wheels 404 which causes rotatable member 424 to begin rotating. As more force is supplied to rod 414, axle 426 is pushed against liners 416 and 418 to increase the frictional force and to more rapidly slow or stop the rotating wheels without causing any jerking as described in previous embodiments. Following braking, rod 414 is lifted to pivot rotatable member 424 away from wheels 404.

In the event that brake liners 416 and 418 become excessively worn, they may be replaced by simply removing one or more wheels 404 and pulling liners 416 and 418 from arms 410 and 412. Rotatable member 424 is removed from the old liners, and a pair of new liners are pressed onto arms 410 and 412.

Referring now to FIGS. 49–52, braking system 400 may optionally be provided with another braking scheme which is configured to continuously feed a fresh amount of a braking surface to rotatable member 424. Such an arrangement provides a large supply of braking material that is continuously supplied to rotatable member 424 to greatly reduce the need to replace the braking material due to excessive wear. Further, by continuously feeding fresh braking material, the chances of abnormal wear will be reduced so that a continuous and smooth breaking process will result.

Figure 53:
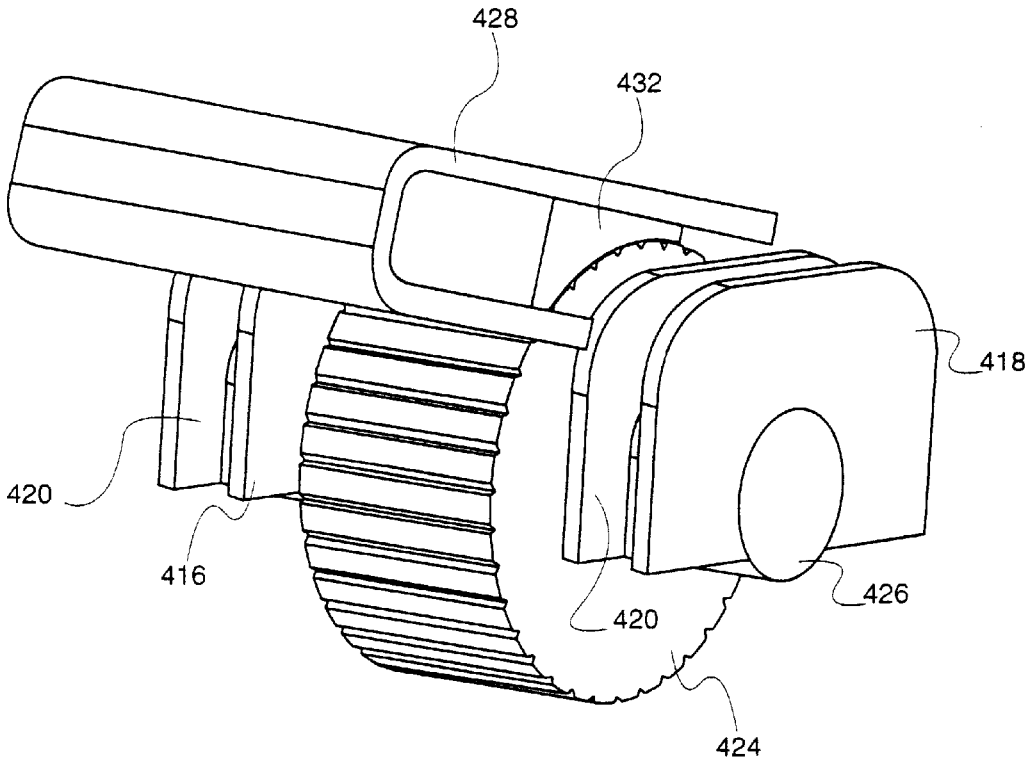
FIG. 53 illustrates a rotatable member, a pair of liners, and a housing having a brake pad of the braking system of FIG. 52.
Figure 54:
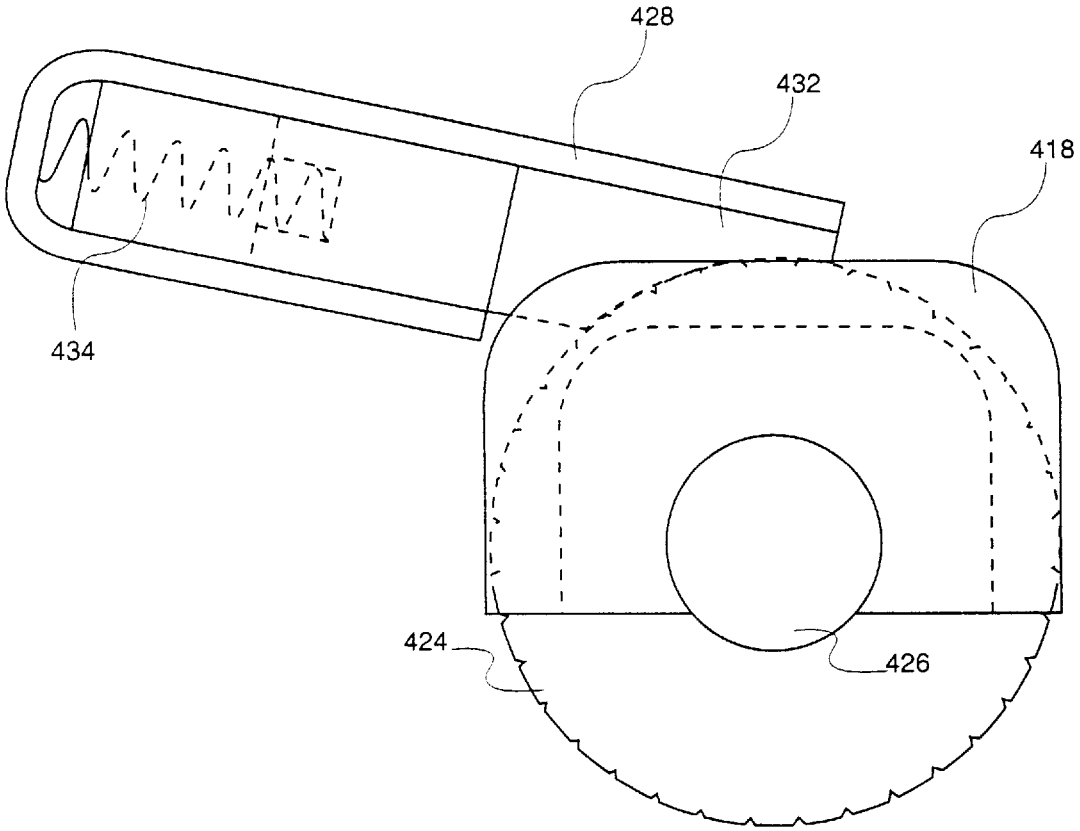
FIG. 54 is a side view of FIG. 53.
Figure 55:
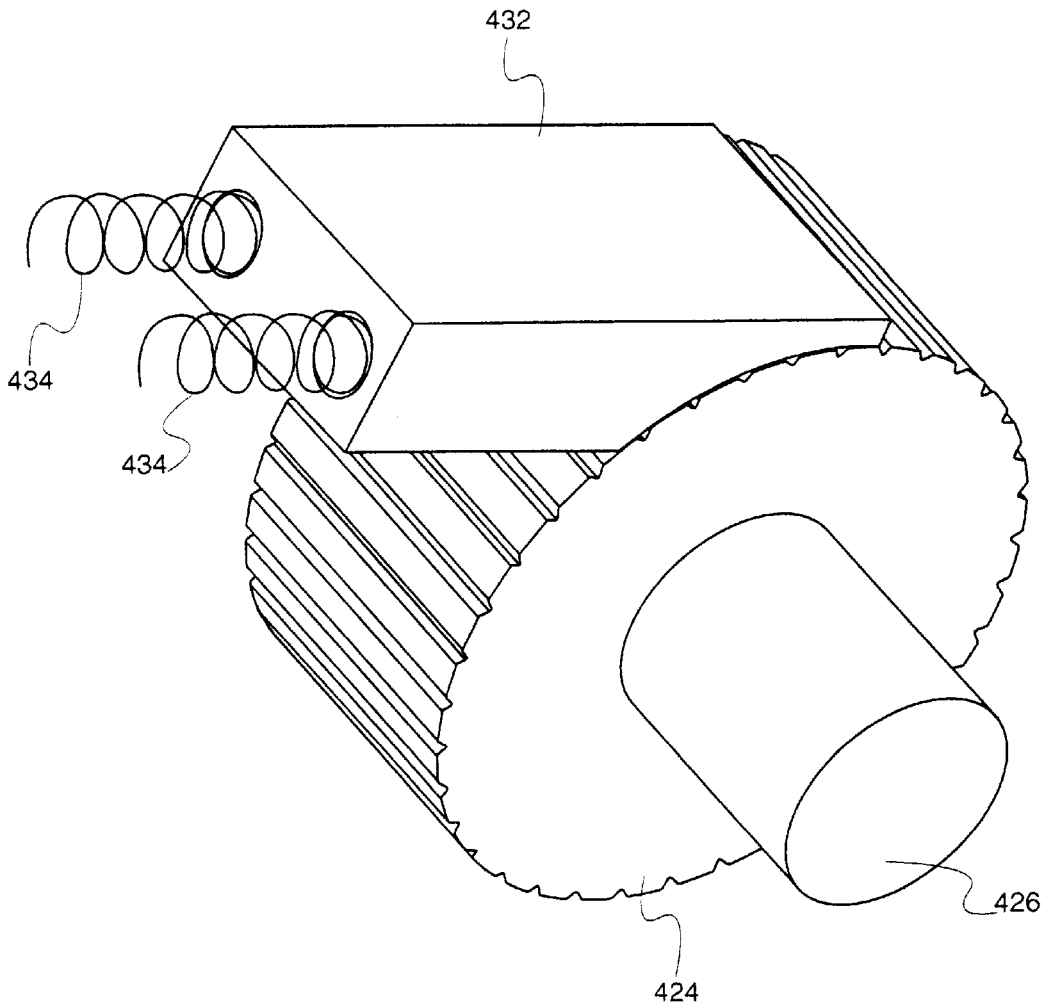
FIG. 55 illustrates the rotatable member and brake pad of FIG. 53.
Figure 56:
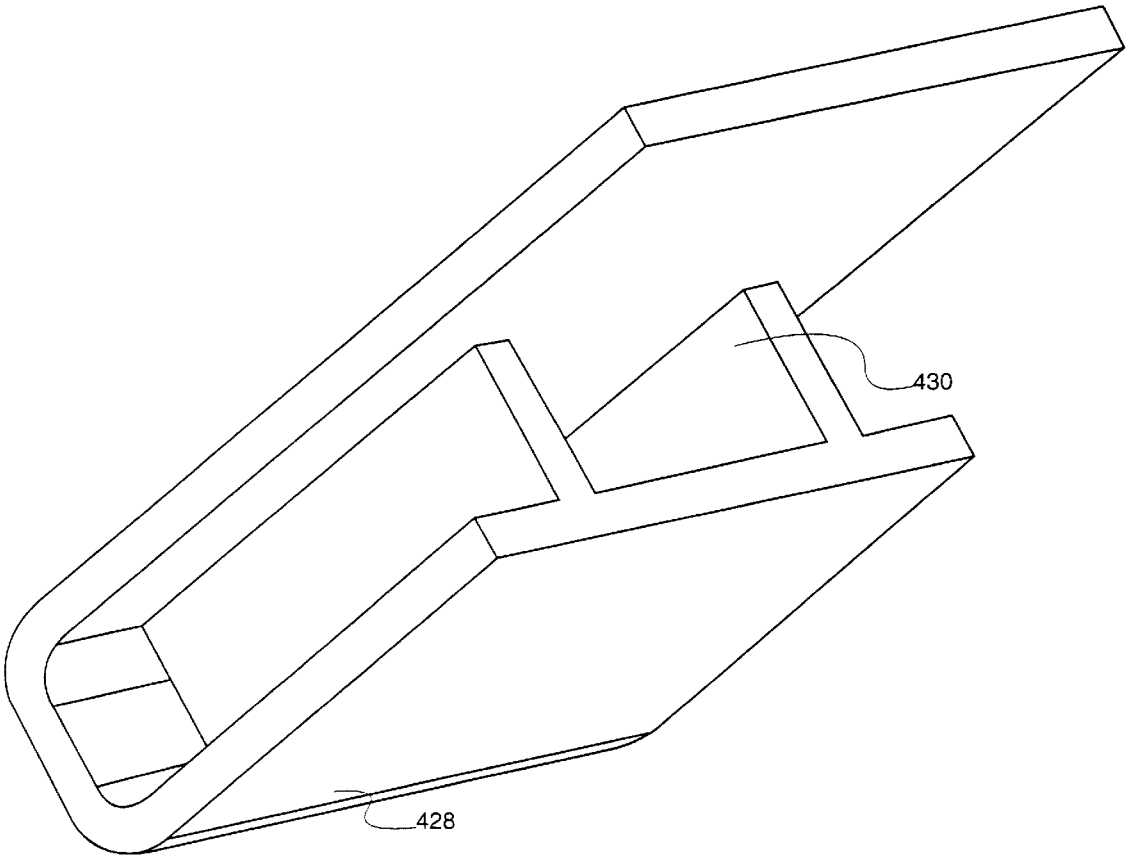
FIG. 56 is a perspective view of the housing of FIG. 53.

Coupled between arms 410 and 412, such as by a weld is a housing 428. As best shown in FIG. 56, housing 428 includes a chamber 430. As best shown in FIGS. 53 and 54, slidably held within chamber 430 is a brake pad 432. Also held within chamber 430 between housing 428 and brake pad 432 are a pair of springs 434 (see FIGS. 49, 54, and 55). Springs 434 serve to bias brake pad 432 against rotatable member 424. Conveniently, brake pad 432 includes a cylindrical surface which matches the outer surface of rotatable member 424, as shown in FIG. 55. As the cylindrical surface of brake pad 432 becomes worn, springs 434 feed pad 432 from housing 428 and against rotatable member 424 so that fresh braking material is continuously supplied to rotatable member 424. In the event that brake pad 432 becomes excessively worn, the remainder of the brake pad may be removed from housing 428 and replaced with a new brake pad. Preferably, brake pad 432 is constructed of materials which are similar to those used to construct liners 416 and 418 as previously described.

Housing 428 is positioned so as to be generally above rotatable member 424. In this way, brake pad 432 rests on the upper part of rotatable member 424. As best shown by the arrows in FIG. 52, when a skater skates in a forward direction, wheels 404 are rotated in counter clockwise direction when viewed from a right side of the skate. This causes rotatable member 424 to rotate in a clockwise direction. As best illustrated in FIG. 54, the grooves or serrations on rotatable member 424 tend to pull brake pad 432 from housing 428. Housing 428 is angled slightly downward relative to rotatable member 424 so that brake pad 432 becomes wedged between rotatable member 424 and housing 428. The amount of force supplied to braking pad 432 by rotatable member 424 may be varied by varying the amount of force supplied by rod 414 and by varying the flexibility and size of openings 422 in liners 416 and 418, and by varying the spring type and tension of spring 434 and/or the composition and hardness of braking pad 432. In turn, this may be employed to control the rate at which slowing or stopping occurs.

Figure 49:
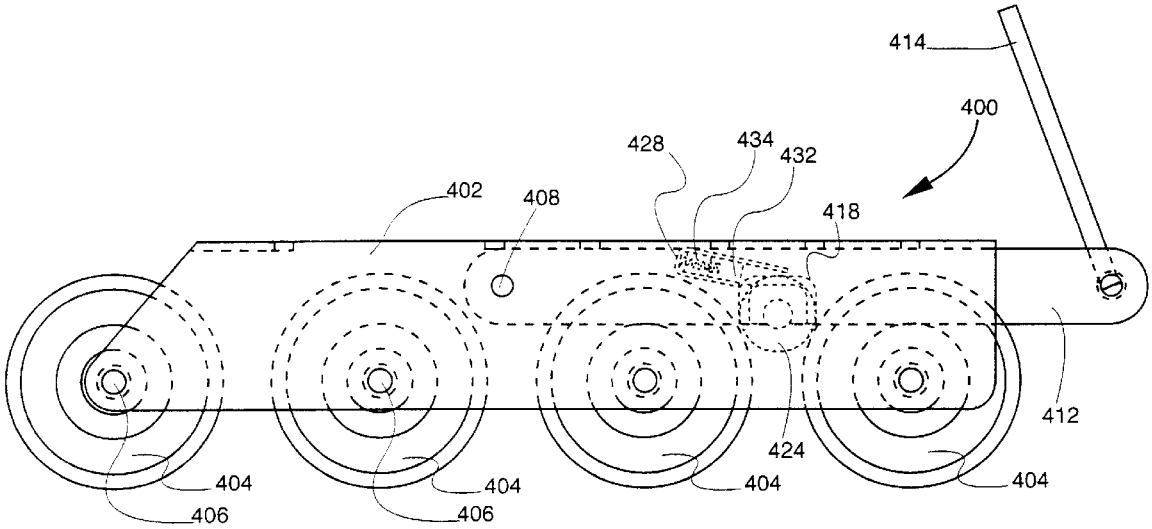
FIG. 49 is a side view of yet another alternative embodiment of a braking system according to the invention.
Figure 50:
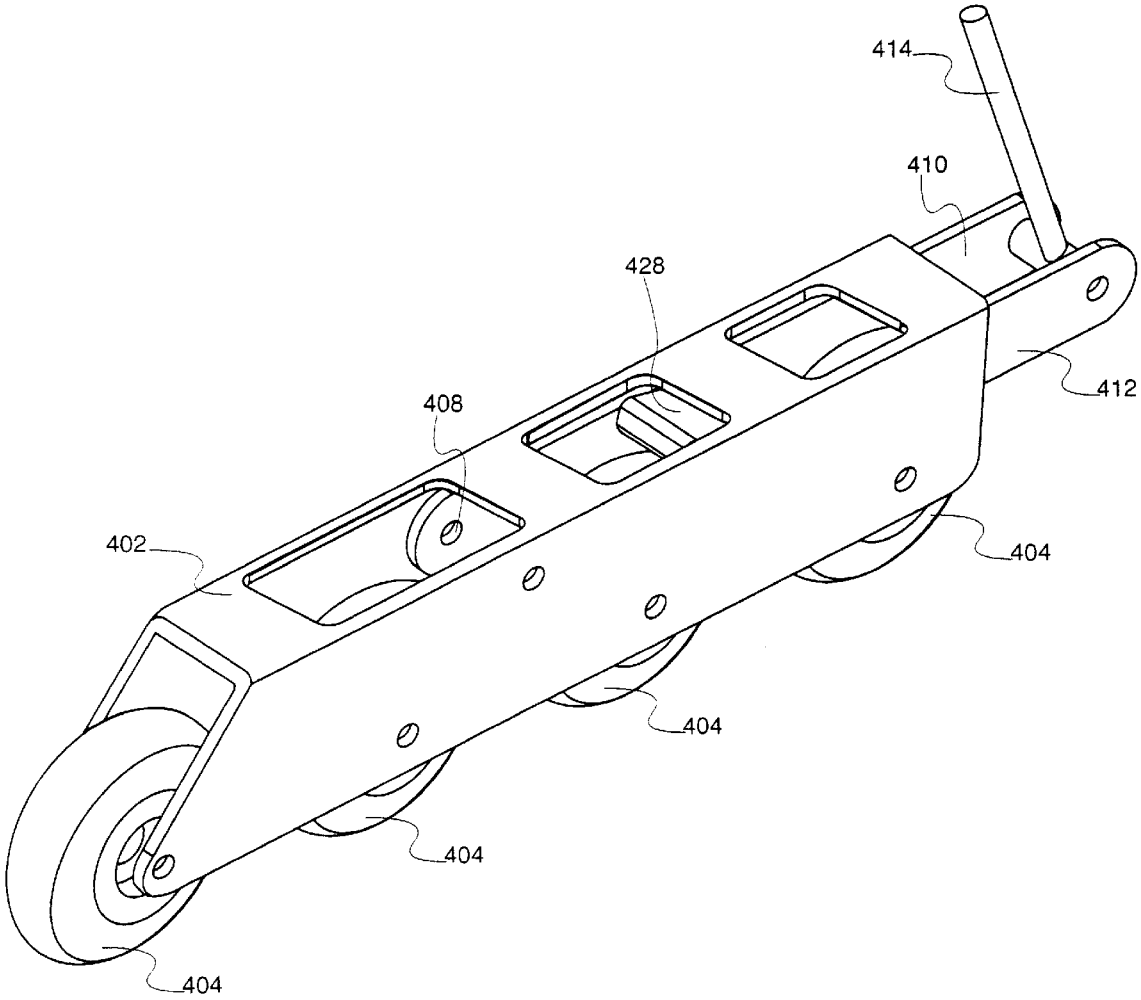
FIG. 50 is a top perspective view of the braking system of FIG. 49.
Figure 51:
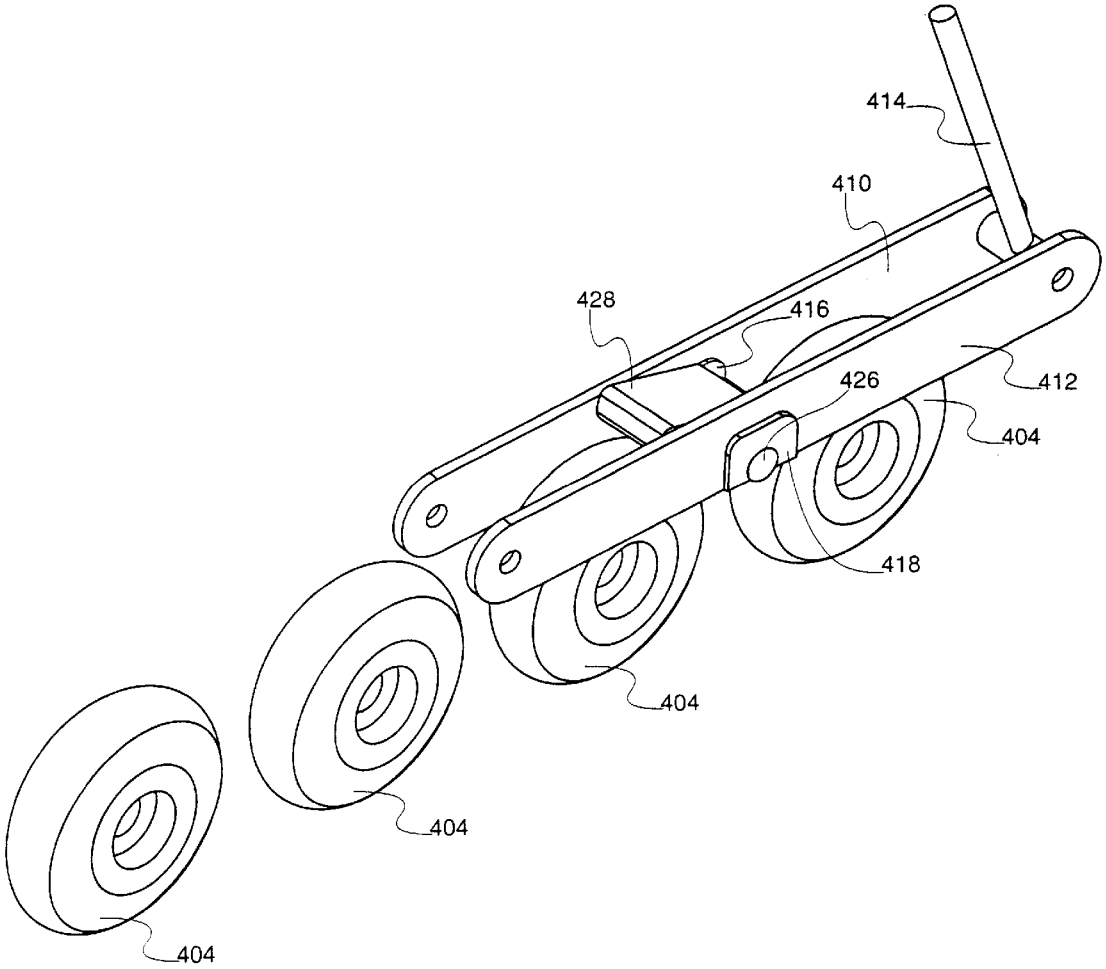
FIG. 51 illustrates the braking system of FIG. 50 with a frame of the skate being removed.
Figure 52:
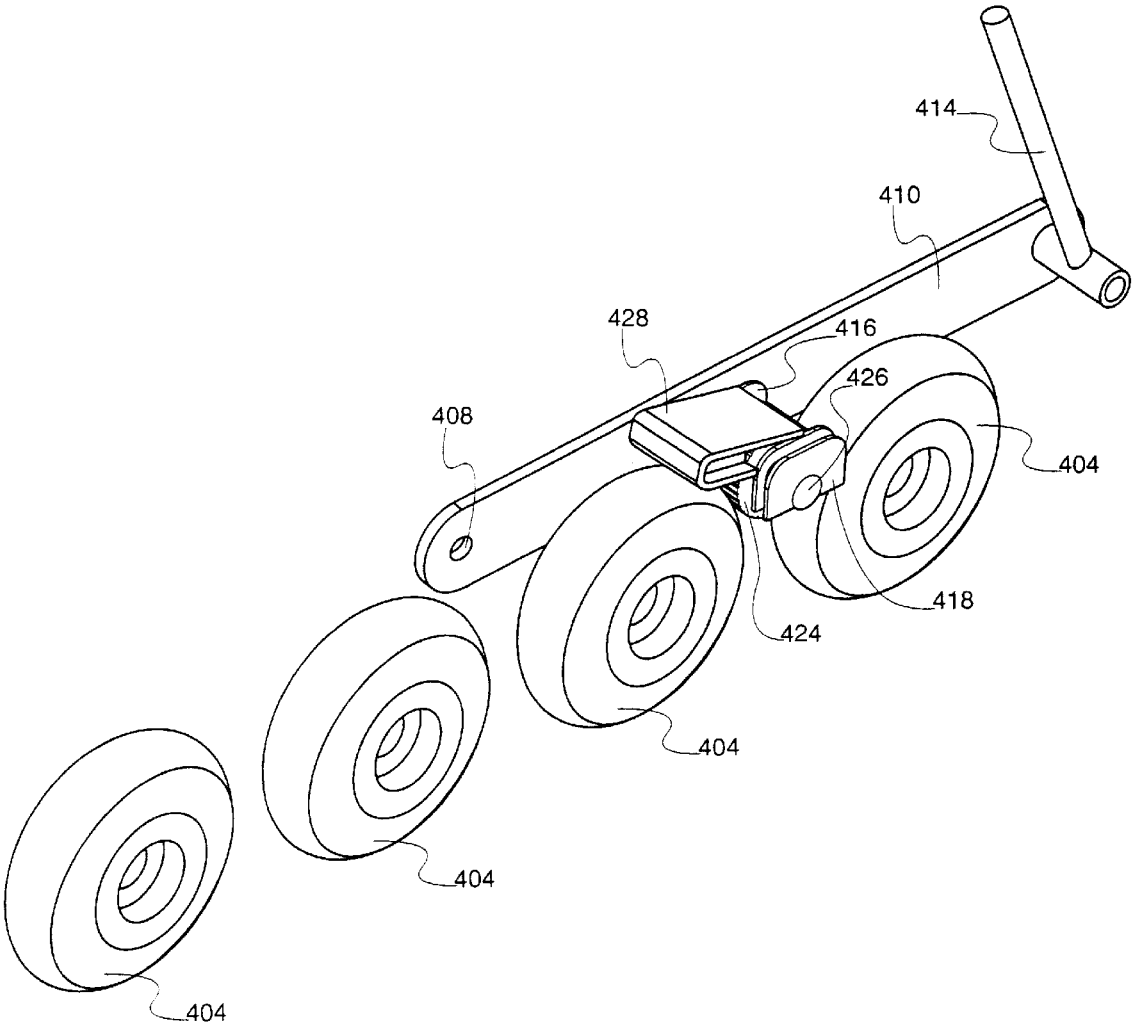
FIG. 52 illustrates the braking system of FIG. 51 with one of the brake arms being removed.

As shown in FIG. 49, housing 428 and brake pad 432 are used in combination with liners 416 and 418. In this manner, three braking surfaces are employed to slow rotatable member 424. However, it will be appreciated that any one of these braking mechanisms may be employed separately. For example, rotatable member 424 may be coupled to holes in arms 410 and 412 without the use of liners 416 and 418. In this way, braking would occur solely with the use of brake pad 432. Alternately, liner 416 may be used alone or in combination with liner 420, and without the use of brake pad 432 as previously described in connection with FIG. 42.

Due to the contact between brake pad 432 and rotatable member 424, some heat will be generated during braking to cause the temperature of rotatable member 424 to increase. As rotatable member 424 contacts wheels 404, heat transfer to the wheels is controlled either by constructing rotatable member 424 of an insulating material such as ceramic, and/or by enhancing heat transfer by providing cooling passages in axle 426 and by constructing axle 426 of a thermally conductive material such as aluminum. As an alternative, it will be appreciated that rotatable member 424 may include a rotating region which does not contact the wheel (such as a recessed insulated cylinder coupled to axle 426) to which brake pad 432 engages. Insulation may then be provided between this component and rotatable member 424 so that essentially no heat generated during braking will be transferred from rotatable member 424 to wheels 404.

Although the foregoing invention has been described in some detail for purposes of clarity of understanding, alternative embodiments of the invention will occur to those skilled in the art. Therefore, the above description should not be taken as limiting the scope of the invention. Instead, the scope of the invention should be determined chiefly with reference to the appended claims, along with the full scope of equivalents to which those claims are entitled.

What is claimed is:

1. A braking system for a roller skate having a plurality of wheels, the system comprising:

at least one braking surface spaced-apart from the wheels; and a rotatable wheel engaging member between the braking surface and at least one of the wheels, wherein the rotatable wheel engaging member is caused to rotate when moved against at least one of the wheels when rotating, and wherein the rotatable member has an engaging surface which moves against the braking surface upon rotation of the rotatable member by the wheel to slow or stop the wheel.

2. A system as in claim 1, wherein the rotatable wheel engaging member includes an axle having the engaging surface, and wherein the braking surface comprises a liner at least partially disposed about the axle.

3. A system as in claim 2, further comprising at least one brake arm which is adapted to be pivotally coupled to a frame of the skate, wherein the liner is attached to the arm and includes an opening through which the axle is held such that pivoting of the arm moves the rotatable member into contact with the wheel and forces the axle against the liner.

4. A system as in claim 3, further comprising a pair of spaced apart arms, wherein each arm includes a liner having an opening, and wherein the rotatable wheel engaging member is positioned between the arms with the axle being held within the openings.

5. A system as in claim 3, further comprising a brake pad and a feeding mechanism to maintain the brake pad in contact with the rotatable member.

6. A system as in claim 5, wherein the brake pad includes a cylindrical surface which is in contact with the rotatable member.

7. A system as in claim 5, wherein the brake pad is held within a housing, and wherein the feeding mechanism comprises a spring disposed between the housing and the brake pad.

8. A system as in claim 3, further comprising a rod connected to the brake arm, whereby the brake arm may be pivoted by pushing on the rod.

9. A system as in claim 1, wherein the wheels of the roller skate are in-line with each other, and wherein the rotatable member is positioned between one or more of the in-line wheels so that one or more wheels may be slowed or stopped at substantially the same time.

10. A braking system for a roller skate having a plurality of in-line wheels which rotate when the roller skate is rolling over a skating surface, the system comprising:

a rotatable member which is positionable to contact two of the wheels that are adjacent each other when the two wheels are rotating, wherein positioning of the rotatable member against the two wheels causes the rotatable member to rotate;

a mechanism to move the rotatable member into and out of contact with the two wheels while the roller skate is rolling over the skating surface using movement of the skater's leg; and a braking surface engageable with at least a portion of the rotatable member, wherein engagement of the braking surface with the portion of the rotating rotatable member slows rotation of the in-line wheels.

11. A system as in claim 10, wherein the rotatable wheel engaging member includes an axle, and wherein the braking surface comprises a liner at least partially disposed about the axle.

12. A system as in claim 11, further comprising at least one brake arm which is adapted to be pivotally coupled to a frame of the skate, wherein the liner is attached to the arm and includes an opening through which the axle is held such that pivoting of the arm moves the rotatable member into contact with the wheel and forces the axle against the liner.

13. A system as in claim 12, further comprising a pair of spaced apart arms, wherein each arm includes a liner having an opening, and wherein the rotatable wheel engaging member is positioned between the arms with the axle being held within the openings.

14. A system as in claim 10, wherein the braking surface comprises a brake pad, and further comprising a feeding mechanism to maintain the brake pad in contact with the rotatable member.

15. A system as in claim 14, wherein the brake pad includes a cylindrical surface which is in contact with the rotatable member.

16. A system as in claim 14, wherein the brake pad is held within a housing, and wherein the feeding mechanism comprises a spring disposed between the housing and the brake pad.

17. A system as in claim 16, further comprising at least one brake arm which is adapted to be pivotally coupled to a frame of the skate, wherein the housing is attached to the arm such that the brake pad is disposed generally above the rotatable member, and wherein the rotatable member is rotatably coupled to the arm such that pivoting of the arm moves the rotatable member into contact with the wheel.

18. A system as in claim 10, wherein the rotatable member may be positioned to contact two of the wheels at substantially the same time, wherein the two contacted wheels may be slowed by the rotatable member.

19. A system as in claim 17, further comprising a rod connected to the brake arm, whereby the brake arm may be moved by pushing on the rod.

20. A roller skate, comprising:

a boot;

a frame which connects a plurality of in-line wheels to the boot;

a braking surface movably attached to the frame; and a rotatable wheel engaging member movably attached to the frame and disposed between the braking surface and at least one of the wheels, wherein the rotatable wheel engaging member is caused to rotate when moved against at least one of the wheels when rotating, and wherein the rotatable member has an engaging surface which moves against the braking surface upon rotation of the rotatable member by the wheel to slow or stop the wheel.

21. A method for slowing or stopping a moving roller skate, comprising:

contacting a rotating wheel of the roller skate with a rotatable member such that the rotatable member begins to rotate;

frictionally slowing the rotatable member by contacting a braking surface against at least a portion of the rotatable member to slow or stop the wheel; and maintaining the rotatable member spaced apart from the wheel of the skate until contacting the rotatable member with the rotating wheel.

22. A method as in claim 21, wherein the slowing step further comprises forcing the braking surface against an axle of the rotatable member.

23. A method as in claim 22, wherein the braking surface comprises a liner that is disposed about the axle, wherein the roller skate further includes a brake arm to hold the liner, and further comprising moving the brake arm to engage the rotatable member against the wheel and force the axle against the liner.

24. A method as in claim 23, wherein the braking surface comprises a brake pad, and further comprising biasing the brake pad against the rotatable member.

25. A method as in claim 24, wherein the brake pad is held within a housing, and further comprising removing the brake pad from the housing and replacing the brake pad with a new brake pad.

26. A method as in claim 23, further comprising rotating a cuff on the roller skate to move the brake arm.

27. A method as in claim 21, further comprising engaging the rotatable member with the rotating wheel without causing substantial jerking motion to the roller skate.

28. A method as in claim 21, further comprising allowing the wheels to rotate at varying speeds when there is no braking action to facilitate turning of the skate.

* * * * *